US010336104B2

(12) United States Patent
Yasuki

(10) Patent No.: US 10,336,104 B2
(45) Date of Patent: Jul. 2, 2019

(54) TAPE PRINTING APPARATUS

(71) Applicant: SEIKO EPSON CORPORATION, Tokyo (JP)

(72) Inventor: Hirosuke Yasuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/906,686

(22) Filed: Feb. 27, 2018

(65) Prior Publication Data

US 2018/0250958 A1 Sep. 6, 2018

(30) Foreign Application Priority Data

Mar. 1, 2017 (JP) ..... 2017-038233

(51) Int. Cl.

| | |
|---|---|
| ***B41J 11/00*** | (2006.01) |
| ***B41J 11/66*** | (2006.01) |
| ***B41J 3/407*** | (2006.01) |
| ***B41J 15/04*** | (2006.01) |
| ***B41J 2/355*** | (2006.01) |
| ***B41J 2/32*** | (2006.01) |
| ***B41J 11/70*** | (2006.01) |

(52) U.S. Cl.

CPC ..... *B41J 11/009* (2013.01); *B41J 2/32* (2013.01); *B41J 2/355* (2013.01); *B41J 3/4075* (2013.01); *B41J 11/663* (2013.01); *B41J 11/70* (2013.01); *B41J 15/044* (2013.01)

(58) Field of Classification Search

CPC ... B41J 2/35; B41J 2/355; B41J 2/3551; B41J 2/32; B41J 11/009; B41J 2/3553; B41J 2/3555; B41J 2/3556; B41J 2/3558; B41J 3/4075; B41J 11/663; B41J 15/044

See application file for complete search history.

(56) References Cited

U.S. PATENT DOCUMENTS

| | | | |
|---|---|---|---|
| 2010/0166475 A1 | 7/2010 | Yamaguchi et al. | |
| 2010/0166477 A1 | 7/2010 | Yamaguchi et al. | |
| 2010/0166478 A1 | 7/2010 | Yamaguchi et al. | |
| 2010/0166479 A1 | 7/2010 | Yamaguchi et al. | |
| 2010/0166480 A1 | 7/2010 | Yamaguchi et al. | |

(Continued)

FOREIGN PATENT DOCUMENTS

| | | | | |
|---|---|---|---|---|
| JP | 2008201017 | * | 9/2008 | ..... B41J 2/35 |
| JP | 2010-149439 A | | 7/2010 | |

(Continued)

*Primary Examiner* — Kristal Feggins

(74) *Attorney, Agent, or Firm* — Foley & Lardner LLP

(57) ABSTRACT

A tape printing apparatus includes a cartridge mounting portion in which a tape cartridge is mounted, the tape cartridge including a first case that has a peripheral wall portion in which a first hook projects from a tip end surface, and for which, on an outer peripheral surface of the peripheral wall portion, depths of recessed parts of a first base-end-side part, which is a site that is further on a base end side than a base end portion of the first hook, are different for a plurality of types of tape cartridge, and a second case that has a first hook receiving portion with which the first hook engages, and a first base-end-side part detection sensor, an output of which changes depending on the depths of the recessed parts at the first base-end-side part in a state in which a tape cartridge is mounted in the cartridge mounting portion.

6 Claims, 20 Drawing Sheets

(56) References Cited

U.S. PATENT DOCUMENTS

| | | | |
|---|---|---|---|
| 2010/0247205 | A1 | 9/2010 | Yamaguchi et al. |
| 2010/0247206 | A1 | 9/2010 | Yamaguchi et al. |
| 2010/0247207 | A1 | 9/2010 | Sago et al. |
| 2010/0247208 | A1 | 9/2010 | Yamaguchi et al. |
| 2010/0247209 | A1 | 9/2010 | Yamaguchi et al. |
| 2010/0247210 | A1 | 9/2010 | Yamaguchi et al. |
| 2010/0247212 | A1 | 9/2010 | Yamaguchi et al. |
| 2010/0254742 | A1 | 10/2010 | Yamaguchi et al. |
| 2012/0008999 | A1 | 1/2012 | Yamaguchi et al. |
| 2012/0080550 | A1 | 4/2012 | Yamaguchi et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2013/0142560 | A1 | 6/2013 | Yamaguchi et al. |
| 2013/0315644 | A1 | 11/2013 | Yamaguchi et al. |
| 2014/0112694 | A1 | 4/2014 | Yamaguchi et al. |
| 2014/0175204 | A1 | 6/2014 | Yamaguchi et al. |
| 2014/0199108 | A1 | 7/2014 | Yamaguchi et al. |
| 2014/0204170 | A1 | 7/2014 | Yamaguchi et al. |
| 2014/0205341 | A1 | 7/2014 | Yamaguchi et al. |
| 2014/0205342 | A1 | 7/2014 | Yamaguchi et al. |
| 2014/0205343 | A1 | 7/2014 | Yamaguchi et al. |
| 2014/0205344 | A1 | 7/2014 | Yamaguchi et al. |
| 2014/0205345 | A1 | 7/2014 | Yamaguchi et al. |
| 2014/0205346 | A1 | 7/2014 | Yamaguchi et al. |
| 2014/0205347 | A1 | 7/2014 | Yamaguchi |
| 2014/0205348 | A1 | 7/2014 | Yamaguchi et al. |
| 2014/0205349 | A1 | 7/2014 | Yamaguchi et al. |
| 2014/0205350 | A1 | 7/2014 | Yamaguchi et al. |
| 2014/0205352 | A1 | 7/2014 | Yamaguchi et al. |
| 2014/0205353 | A1 | 7/2014 | Yamaguchi et al. |
| 2014/0320581 | A1 | 10/2014 | Yamaguchi et al. |
| 2015/0174932 | A1 | 6/2015 | Yamaguchi et al. |
| 2015/0183246 | A1 | 7/2015 | Yamaguchi et al. |
| 2015/0283838 | A1 | 10/2015 | Sakano |
| 2015/0298476 | A1 | 10/2015 | Yamaguchi et al. |
| 2016/0039230 | A1 | 2/2016 | Yamaguchi et al. |
| 2016/0229210 | A1 | 8/2016 | Yamaguchi et al. |
| 2016/0243867 | A1 | 8/2016 | Sakano |
| 2016/0361918 | A1 | 12/2016 | Yamaguchi et al. |
| 2016/0368284 | A1 | 12/2016 | Yamaguchi et al. |
| 2017/0008318 | A1 | 1/2017 | Yamaguchi et al. |
| 2017/0100948 | A1 | 4/2017 | Yamaguchi et al. |
| 2017/0106680 | A1 | 4/2017 | Sakano |
| 2017/0210151 | A1 | 7/2017 | Sakano et al. |
| 2018/0257395 | A1* | 9/2018 | Ogawa ..... B41J 2/32 |

FOREIGN PATENT DOCUMENTS

| | | | | |
|---|---|---|---|---|
| JP | 2012-158175 | A | 8/2012 | |
| JP | 2016-032914 | A | 3/2016 | |
| JP | 2016-150509 | A | 8/2016 | |
| WO | WO-2015146095 | A1 * | 10/2015 | ..... B41J 2/325 |

* cited by examiner

TAPE PRINTING APPARATUS

BACKGROUND

1. Technical Field

The present invention relates to a tape printing apparatus that is capable of detecting the type of a mounted tape cartridge.

2. Related Art

In the related art, as described in JP-A-2012-158175, a tape printing apparatus (tape printer) that is provided with a detection portion (arm detection portion) in which the output changes depending on a combination of the presence or absence of case holes (switch holes) at a plurality of locations of a cartridge case (cassette case), and that detects the type of a tape cartridge (tape cassette) is known. Additionally, in this paragraph, the bracketed words show the terms used in JP-A-2012-158175.

The tape printing apparatus of the related art detects the type of a tape cartridge in a case in which tape cartridges for which the combination of the presence or absence of case holes at a plurality of locations are different for a plurality of types of tape cartridge are mounted. However, since the area in which case holes can be provided in a tape cartridge is limited, there are constraints on the number of case holes that can be provided, and consequently, on the number of types of tape cartridge that can be detected.

SUMMARY

An advantage of some aspects of the invention is to provide a tape printing apparatus that is capable of detecting the type of a tape cartridge in a case in which tape cartridges for which, on an outer peripheral surface of the peripheral wall portion, depths of recessed parts of a base-end-side part, which is a site that is further on a base end side than a base end portion of a hook, are different for a plurality of types of tape cartridge are mounted.

According to an aspect of the invention, there is provided a tape printing apparatus including a cartridge mounting portion in which a tape cartridge is mounted, the tape cartridge including a first case that has a peripheral wall portion in which a hook projects from a tip end surface, and for which, on an outer peripheral surface of the peripheral wall portion, depths of recessed parts of a base-end-side part, which is a site that is further on a base end side than a base end portion of the hook, are different for a plurality of types of tape cartridge, and a second case that has a hook receiving portion with which the hook engages, and a detection portion, an output of which changes depending on the depths of the recessed parts at the base-end-side part in a state in which a tape cartridge is mounted in the cartridge mounting portion.

In this configuration, the output of the detection portion changes depending on the depths of the recessed parts at the base-end-side part of a tape cartridge that is mounted in the cartridge mounting portion. As a result of this, it is possible to detect the type of a tape cartridge in a case in which a tape cartridge for which the depths of the recessed parts at the base-end-side part are different for a plurality of types of tape cartridge is mounted.

In the tape printing apparatus, it is preferable that the detection portion include a detecting device that is positioned in a first position in a state in which a tape cartridge for which the depths of the recessed parts at the base-end-side part is a first depth is mounted in the cartridge mounting portion, and that is positioned in a second position, which is rotated from the first position in a mounting direction of the tape cartridge with a support shaft as the center thereof, in a state in which a tape cartridge for which the depths of the recessed parts at the base-end-side part is a second depth, which is shallower than the first depth, is mounted in the cartridge mounting portion, and that in the detection portion, the output in a state in which the detecting device is positioned in the first position be different from the output in a state in which the detecting device is positioned in the second position.

In this configuration, the detecting device is positioned in the first position in a state in which a tape cartridge for which the depths of the recessed parts at the base-end-side part is the first depth is mounted in the cartridge mounting portion, and the detecting device is positioned in the second position in a state in which a tape cartridge for which the depths of the recessed parts at the base-end-side part is the second depth is mounted in the cartridge mounting portion. As a result of this, in the detection portion, the output changes depending on the depths of the recessed parts at the base-end-side part.

In the tape printing apparatus, it is preferable that the detection portion include a detecting device that is positioned in an protruding position in a state in which a tape cartridge for which the depths of the recessed parts at the base-end-side part is a first depth is mounted in the cartridge mounting portion, and that is positioned in a depressed position, which is retracted from the protruding position in a direction that intersects an attachment and detachment direction of tape cartridges, in a state in which a tape cartridge for which the depths of the recessed parts at the base-end-side part is a second depth, which is shallower than the first depth, is mounted in the cartridge mounting portion, and in the detection portion, the output in a state in which the detecting device is positioned in the protruding position be different from the output in a state in which the detecting device is positioned in the depressed position.

In this configuration, the detecting device is positioned in the protruding position in a state in which a tape cartridge for which the depths of the recessed parts at the base-end-side part is the first depth is mounted in the cartridge mounting portion, and the detecting device is positioned in the depressed position in a state in which a tape cartridge for which the depths of the a recessed parts t the base-end-side part is the second depth is mounted in the cartridge mounting portion. As a result of this, in the detection portion, the output changes depending on the depths of the recessed parts at the base-end-side part.

In the tape printing apparatus, it is preferable that a tape cartridge that has a plurality of the hooks, for which depths of recessed parts at one base-end-side part, which is a site that is further on a base end side than a base end portion of one hook, are different for a plurality of types of tape cartridge in terms of one property, and for which depths of recessed parts of another base-end-side part, which is a site that is further on a base end side than a base end portion of another hook, are different for a plurality of types of tape cartridge in terms of another property be mounted in the cartridge mounting portion, and that one detection portion, an output of which changes depending on the depths of the recessed parts at the one base-end-side part in a state in which a tape cartridge is mounted in the cartridge mounting portion, and another detection portion, an output of which changes depending on the depths of the recessed parts at the other base-end-side part in a state in which a tape cartridge is mounted in the cartridge mounting portion be provided.

In this configuration, types of tape cartridge in terms of one property are detected by one detection portion and types of tape cartridge in terms of another property are detected by another detection portion.

It is preferable that the tape printing apparatus further include a cutter that cuts a tape reeled out from a tape cartridge mounted in the cartridge mounting portion, and a control unit that switches between allowing and prohibiting a cutting operation of the cutter in accordance with the output of the detection portion.

In this configuration, switching is performed between a case in which the cutting operation of the cutter is allowed and a case in which the cutting operation of the cutter is prohibited in accordance with the depths of the recessed parts at the base-end-side part. Therefore, among tape cartridges for which the depths of the recessed parts at the base-end-side part are different for tape cartridges for which whether or not the tape is suitable for cutting by the cutter is different, in a case in which a tape cartridge in which the tape is not suitable for cutting by the cutter is mounted, it is possible to suppress the cutting operation of the cutter from being performed.

It is preferable that the tape printing apparatus further include a thermal head that performs printing on a tape accommodated in a tape cartridge mounted in the cartridge mounting portion, and a control unit that controls the thermal head so as to switch a heat generation temperature in accordance with the output of the detection portion.

In this configuration, switching of the heat generation temperature of the thermal head is performed in accordance with the depths of the recessed parts at the base-end-side part. Therefore, in a case in which tape cartridges for which the depths of the recessed parts at the base-end-side part are different for tape cartridges for which the suitable heat generation temperatures of the thermal head are different are mounted, it is possible to perform printing on tapes at a heat generation temperature of the thermal head that is suited to the mounted tape cartridge.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a tape printing apparatus of the invention will be described. Additionally, in the following drawings, in order to clarify the disposition relationship of each portion, an XYZ orthogonal coordinate system will be displayed according to necessity, but naturally, this is not intended to limit the invention.

Figure 1:
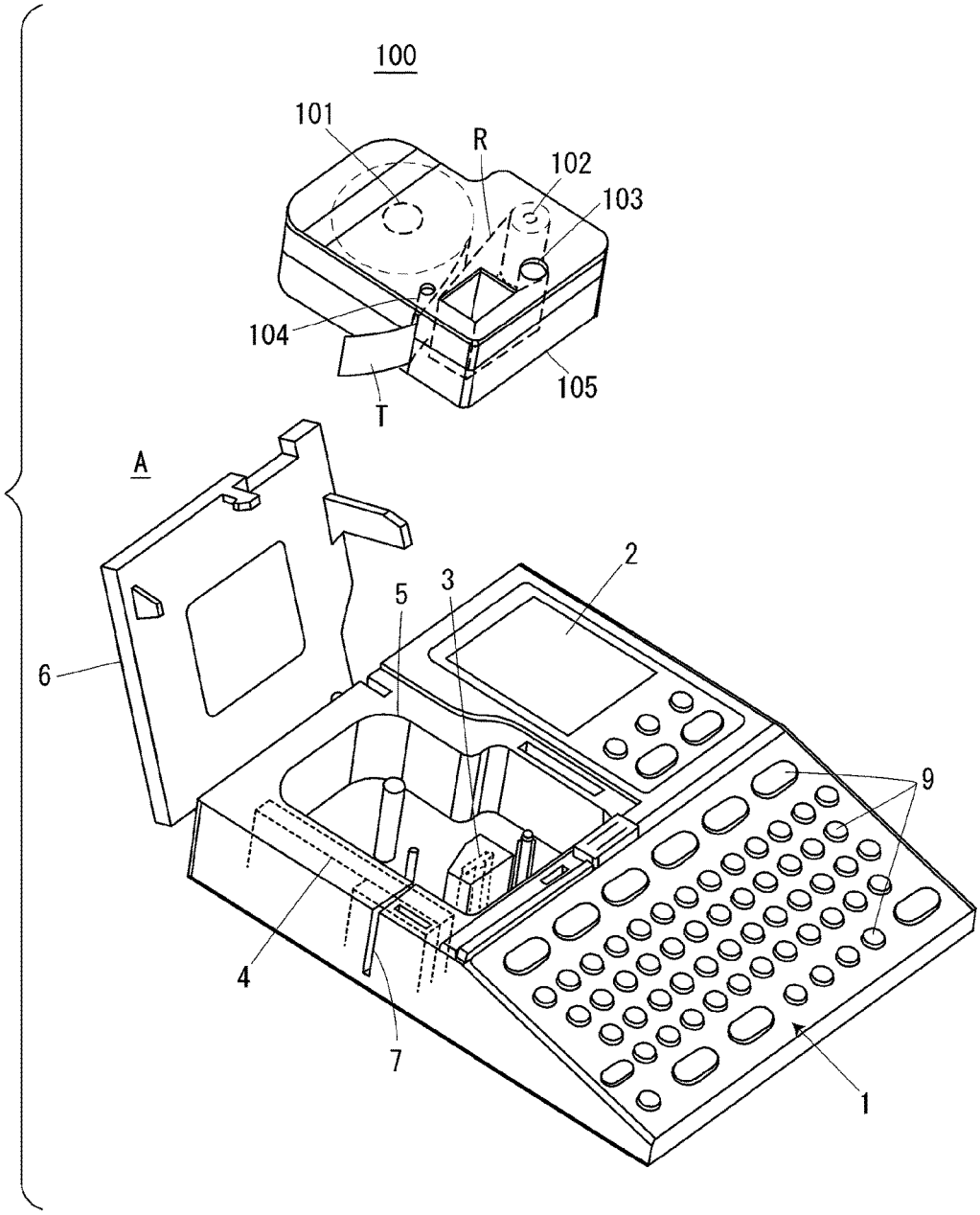
FIG. 1 is a view that shows schematic configurations of a tape printing apparatus according to an embodiment of the invention and a tape cartridge that is mounted in the tape printing apparatus.

Schematic configurations of a tape printing apparatus A and a tape cartridge 100 that is mounted in the tape printing apparatus A will be described below on the basis of FIG. 1.

The tape printing apparatus A is provided with a manipulation panel 1, a display 2, a thermal head 3, and a cutter 4. In addition, a cartridge mounting portion 5, a cover 6, and a tape ejection outlet 7 are provided in the tape printing apparatus A. Additionally, although illustration thereof is omitted from FIG. 1, the tape printing apparatus A is further provided with a controller 14 (refer to FIG. 13).

Buttons 9 such as character buttons, a selection button, and a printing button, are provided in the manipulation panel 1. The manipulation panel 1 detects manipulation of the buttons 9 by a user.

The display 2 displays, for example, an input character string on the basis of detection results of manipulation of the buttons 9. In addition, the display 2 performs various displays on the basis of detection results of sensors provided in each portion of the tape printing apparatus A.

The tape cartridge 100 is mounted in the cartridge mounting portion 5 in an attachable and detachable manner. The tape cartridge 100 is provided with a tape core 101, a ribbon reel-out core 102, a ribbon wind-up core 103, a platen roller 104, and a cartridge case 105 in which the above-mentioned components are accommodated. A tape T is wound around the tape core 101 in a rolled form. An ink ribbon R is wound around the ribbon reel-out core 102 in a rolled form.

A plurality of types of tape cartridge 100 in terms of each property of tape width, cutting suitability, and temperature property are available.

In this instance, cutting suitability is a property of the tape cartridge 100 that shows whether or not the tape T is suitable for cutting by the cutter 4. In terms of the cutting suitability, the tape cartridges 100 are divided into two types; namely, tape cartridges 100 for which the cutting suitability suited to cutting and tape cartridges 100 for which the cutting suitability not suited to cutting. The cutting suitability is a property that is established by the material of the tape T, or the like.

Temperature property is a property of the tape cartridge 100 that shows a suitable temperature as heat generation temperature of the thermal head 3. In terms of the temperature property, the tape cartridges 100 are divided into two types; namely, tape cartridges 100 for which the temperature property is a first temperature and tape cartridges 100 for which the temperature property is a second temperature that is different from the first temperature. The temperature property is a property that is established by the material of the tape T, the material of the ink of the ink ribbon R, or the like.

Tape width is a property of the tape cartridge 100 that shows the dimension in the width direction of an accommodated tape T. In terms of the tape width, the tape cartridges 100 are divided into a plurality that includes tape cartridges 100 for which the tape width is a first width and tape cartridges 100 for which the tape width is a second width that is larger than the first width.

Additionally, the number of types of the tape cartridge 100 in terms of each property of cutting suitability, temperature property, and tape width is not particularly limited, and may be divided into three types or more.

The cover 6 is attached so as to be capable of rotating with one end portion of the cover 6 as a pivot point thereof, and opens and closes an opening portion of the cartridge mounting portion 5. The cover 6 is opened and closed when a user attaches or detaches the tape cartridge 100 to the cartridge mounting portion 5, or the like.

The thermal head 3 is provided in the cartridge mounting portion 5. The thermal head 3 generates heat on the basis of detection results of manipulation of the buttons 9 when the tape T and the ink ribbon R are fed. As a result of this, ink of the ink ribbon R is transferred to the tape T, and an input character string is printed on the tape T. A printed section of the tape T is ejected from the tape ejection outlet 7.

The cutter 4 is provided between the cartridge mounting portion 5 and the tape ejection outlet 7. The cutter 4 cuts, in the width direction of the tape T, the tape T reeled out from the tape cartridge 100 mounted in the cartridge mounting portion 5. As a result of this, a printed section of the tape T is severed. Additionally, although described in more detail later, in a case of a tape cartridge 100 for which the cutting suitability is not suited to cutting, since a cutting operation of the cutter 4 is not performed and a printed section of the tape T is not severed, a user severs the tape T using scissors, for example. A severed printed section of the tape T is affixed to a desired location as a label by a user.

Figure 2:
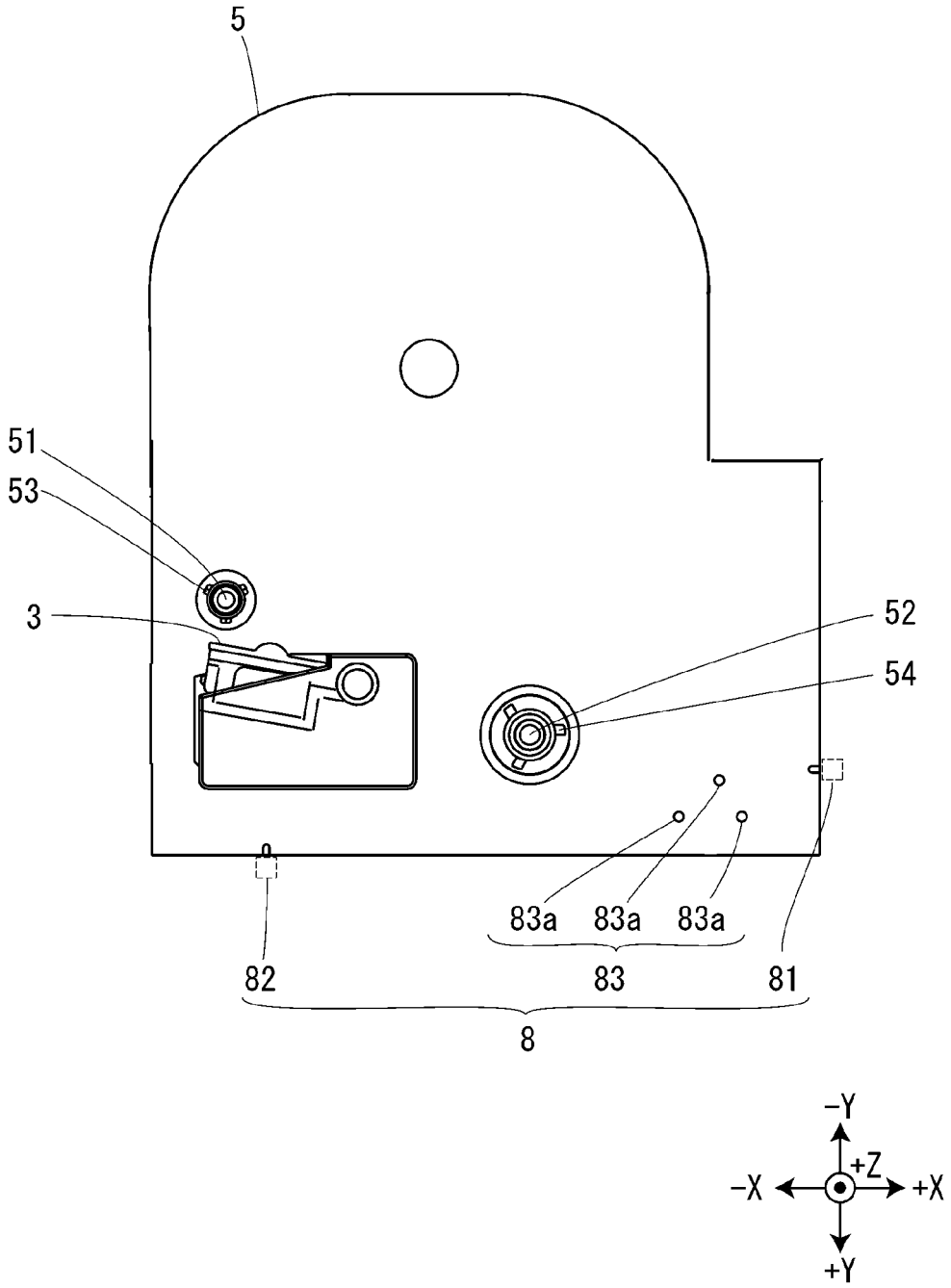
FIG. 2 is a view for describing a member provided in a cartridge mounting portion.

A member provided in the cartridge mounting portion 5 will be described below on the basis of FIG. 2. In addition to the thermal head 3, a cartridge detection sensor 8, a platen shaft 51, and a wind-up shaft 52 are provided in the cartridge mounting portion 5.

The cartridge detection sensor 8 is provided with a first base-end-side part detection sensor 81, a second base-end-side part detection sensor 82, and a case hole detection sensor 83. The first base-end-side part detection sensor 81 and the second base-end-side part detection sensor 82 are provided on the inner peripheral surface of the cartridge mounting portion 5. The case hole detection sensor 83 is provided on the bottom surface of the cartridge mounting portion 5. The first base-end-side part detection sensor 81, the second base-end-side part detection sensor 82, and the case hole detection sensor 83 will be mentioned later.

A platen rotor 53 is provided in the platen shaft 51 in a rotatable manner. When the tape cartridge 100 is mounted in the cartridge mounting portion 5, the platen shaft 51 is inserted into the platen roller 104, and the platen rotor 53 engages with the platen roller 104. In this state, as a result of the platen rotor 53 rotating, the platen roller 104 rotates, and the tape T and the ink ribbon R, which are held between the platen roller 104 and the thermal head 3, are fed.

A wind-up rotor 54 is provided in the wind-up shaft 52 in a rotatable manner. When the tape cartridge 100 is mounted in the cartridge mounting portion 5, the wind-up shaft 52 is inserted into the ribbon wind-up core 103, and the wind-up rotor 54 engages with the ribbon wind-up core 103. In this state, as a result of the wind-up rotor 54 rotating, the ribbon wind-up core 103 rotates, and the ink ribbon R that is reeled out from the ribbon reel-out core 102 is wound up onto the ribbon wind-up core 103.

Figure 3:
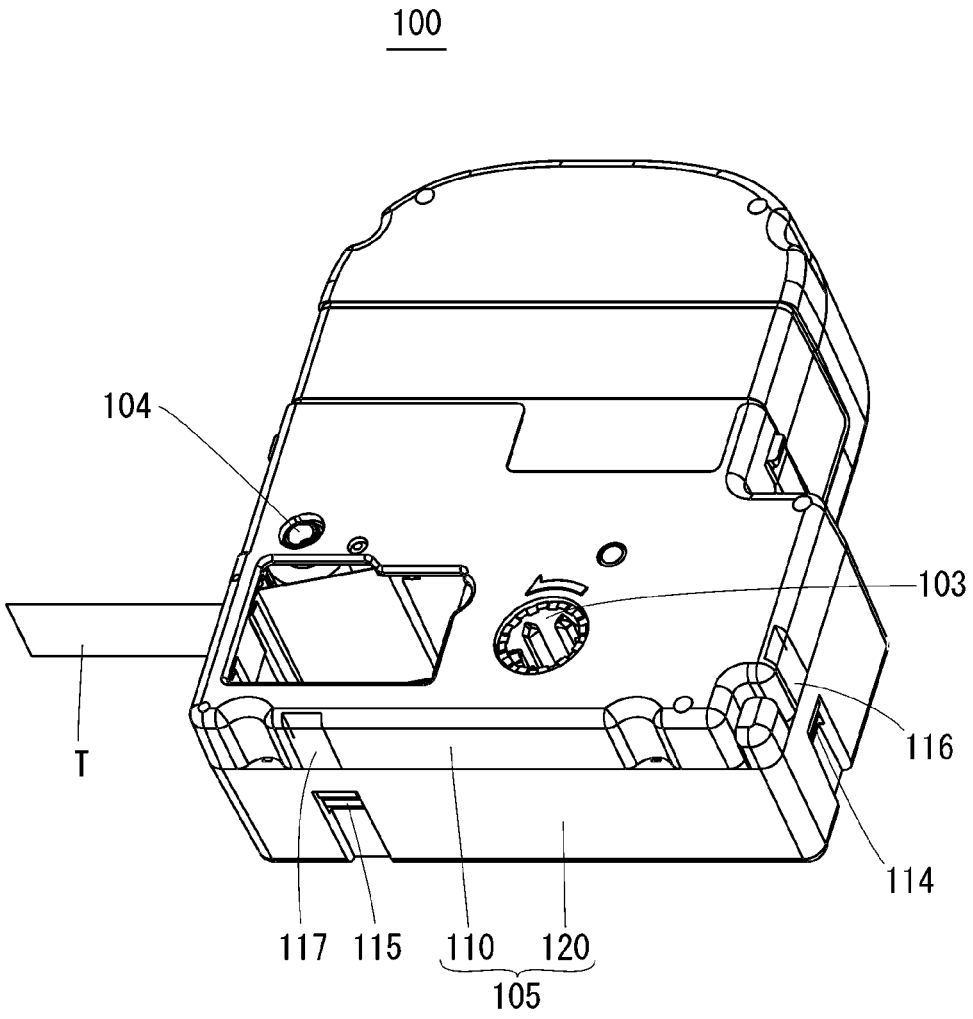
FIG. 3 is a perspective view of the tape cartridge.
Figure 4:
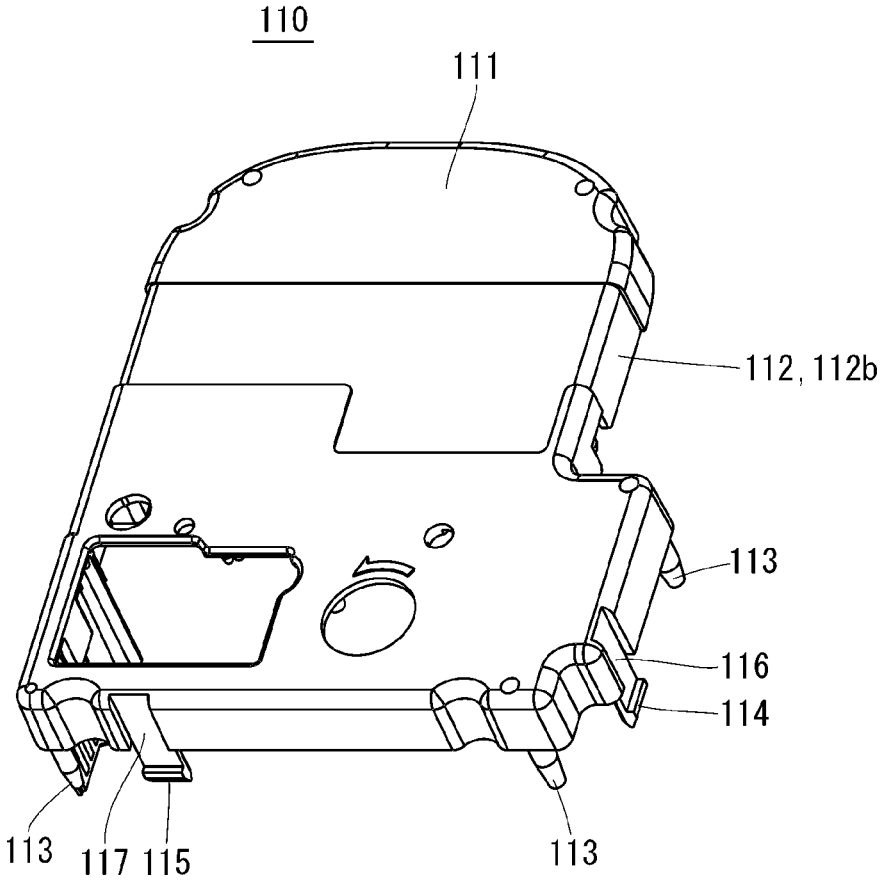
FIG. 4 is a perspective view of a first case of the tape cartridge shown in FIG. 3.
Figure 5:
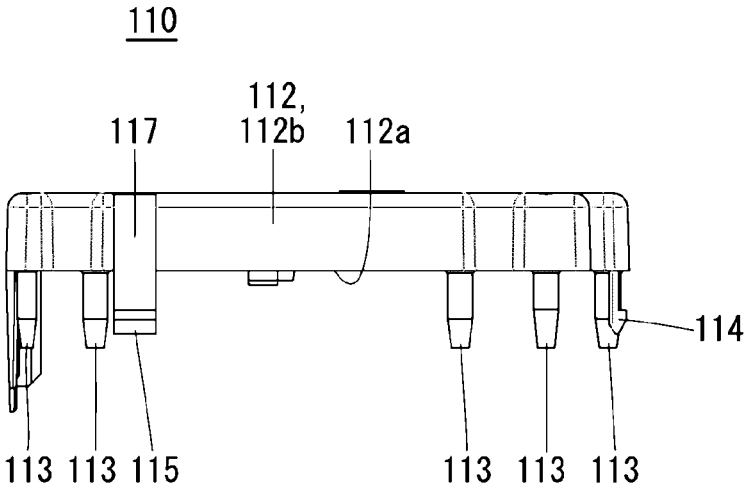
FIG. 5 is a front view of the first case of the tape cartridge shown in FIG. 3.
Figure 6:
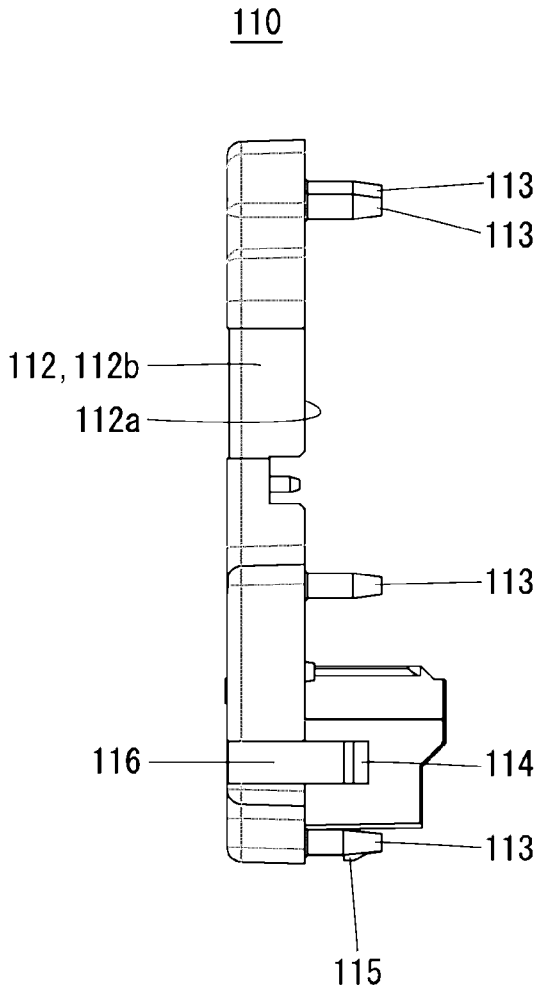
FIG. 6 is a right-side surface view of the first case of the tape cartridge shown in FIG. 3.

The tape cartridge 100 will be described below on the basis of FIGS. 3 to 12. In this instance, the types of the tape cartridge 100 shown in FIG. 3 and the tape cartridge 100 shown in FIG. 8 are different. That is, the tape cartridge 100 shown in FIG. 3 is a tape cartridge for which the cutting suitability is not suited to cutting, the temperature property is the first temperature, and the tape width is the first width. FIGS. 4 to 7 show a first case 110 and a second case 120 that configure the tape cartridge 100 shown in FIG. 3. Meanwhile, the tape cartridge 100 shown in FIG. 8 is a tape cartridge for which the cutting suitability is suited to cutting, the temperature property is the second temperature, and the tape width is the second width. FIGS. 9 to 12 show a first case 110 and a second case 120 that configure the tape cartridge 100 shown in FIG. 8.

As shown in FIGS. 3 and 8, in the manner mentioned earlier, the tape cartridge 100 is provided with the tape core 101 (not illustrated in FIGS. 3 and 8), the ribbon reel-out core 102 (not illustrated in FIGS. 3 and 8), the ribbon wind-up core 103, the platen roller 104, and the cartridge case 105.

The cartridge case 105 is provided with the first case 110 and the second case 120. The first case 110 and the second case 120 are assembled in a disassembleable manner. The first case 110 and the second case 120 are made from a resin, and are respectively manufactured by injection molding, but the materials and methods of manufacturing the first case 110 and the second case 120 are not limited to this configuration.

As shown in FIGS. 4 to 6 and 9 to 11, the first case 110 is provided with a first base portion 111 and a first peripheral wall portion 112. A plurality of fitting pins 113, a first hook 114, and a second hook 115 project from a tip end surface 112*a* of the first peripheral wall portion 112. Additionally, on an outer peripheral surface 112*b* of the first peripheral wall portion 112, a site that is further on the base end side than a base end portion of the first hook 114 is referred to as a first base-end-side part 116. In addition, on the outer peripheral surface 112*b* of the first peripheral wall portion 112, a site that is further on the base end side than a base end portion of the second hook 115 is referred to as a second base-end-side part 117.

Figure 7:
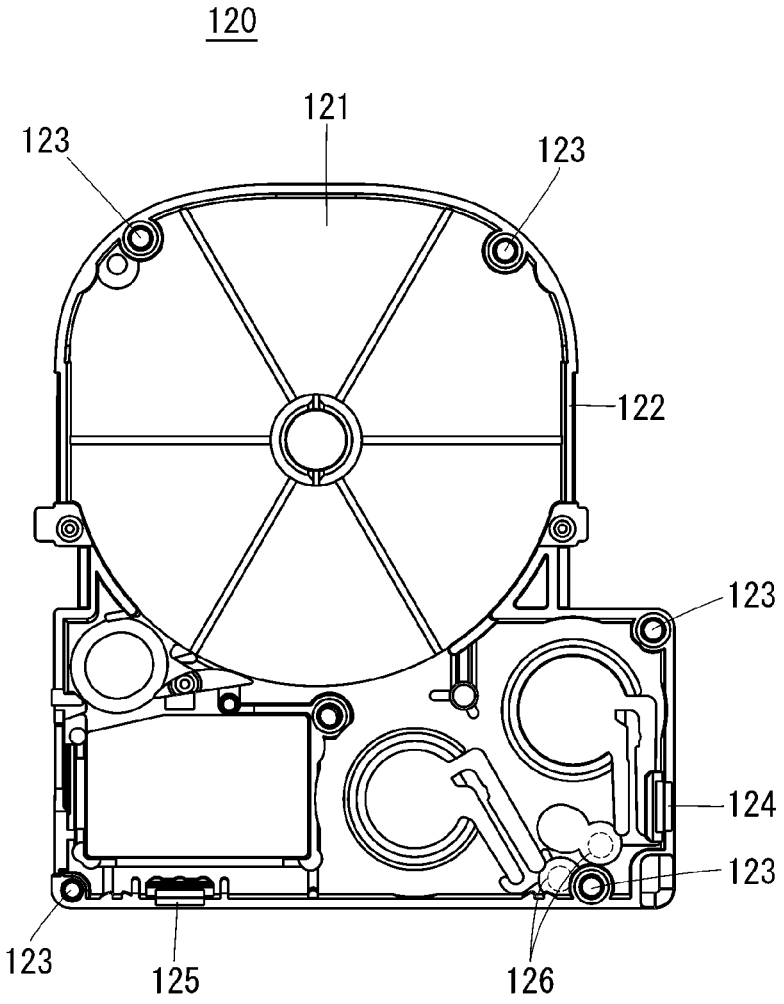
FIG. 7 is a plan view of a second case of the tape cartridge shown in FIG. 3.
Figure 8:
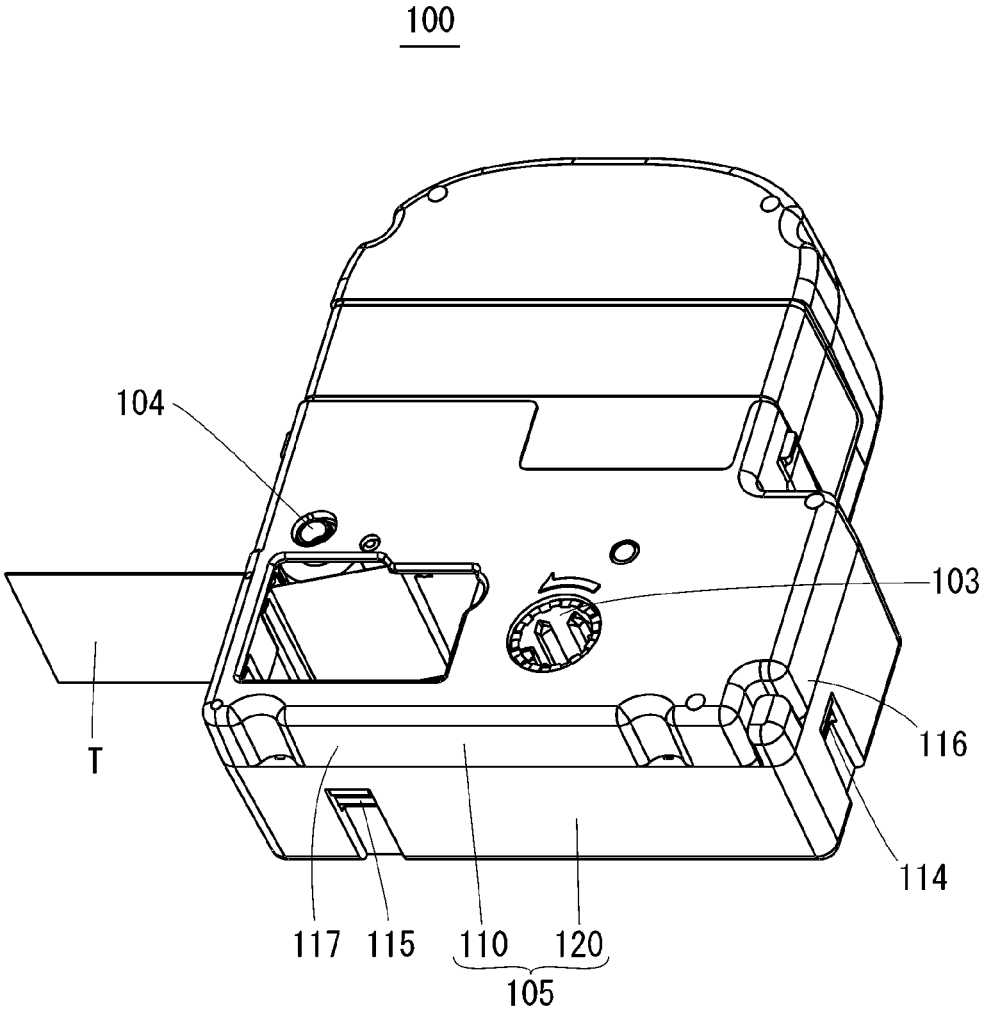
FIG. 8 is a perspective view of a tape cartridge of a different type to that of the tape cartridge shown in FIG. 3.
Figure 9:
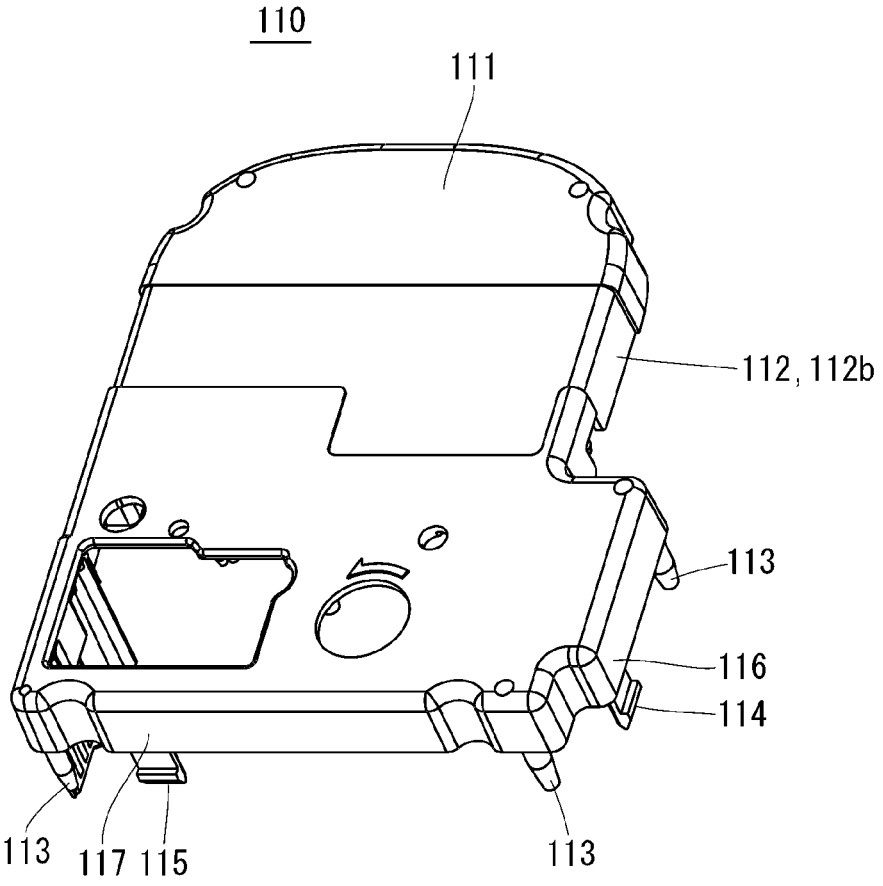
FIG. 9 is a perspective view of a first case of the tape cartridge shown in FIG. 8.
Figure 10:
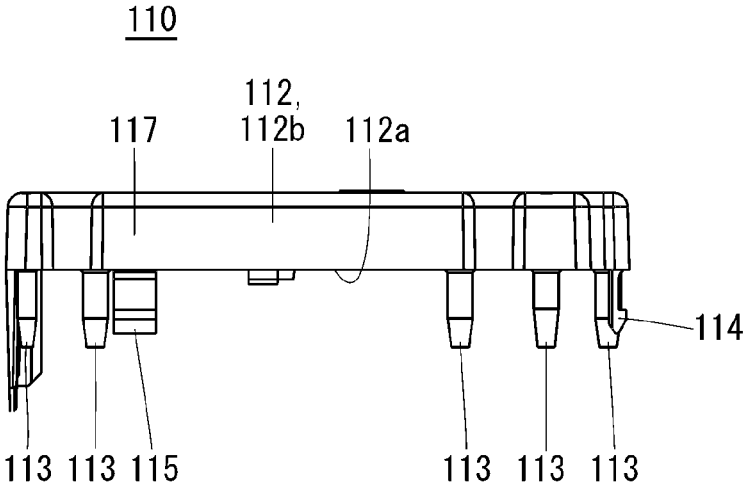
FIG. 10 is a front view of the first case of the tape cartridge shown in FIG. 8.
Figure 11:
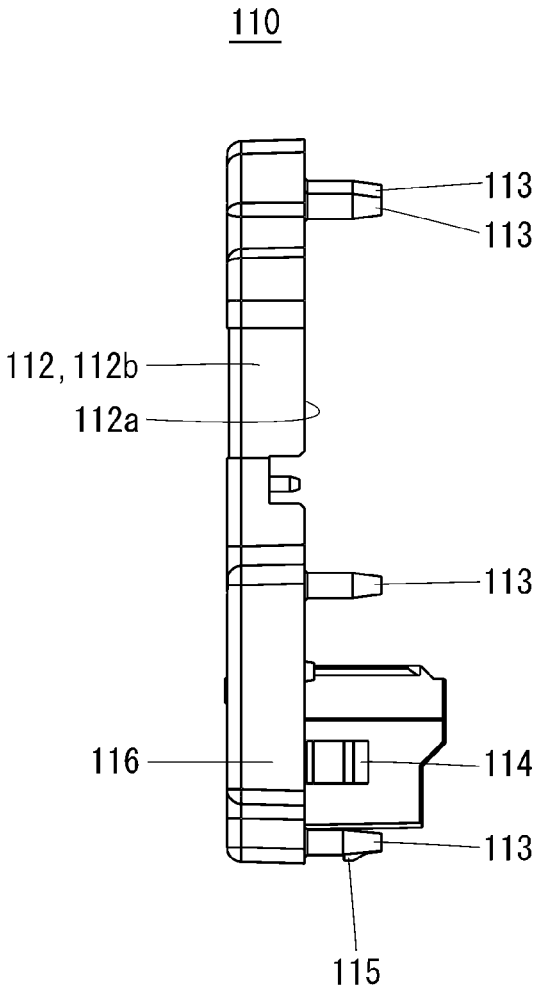
FIG. 11 is a right-side surface view of the first case of the tape cartridge shown in FIG. 8.
Figure 12:
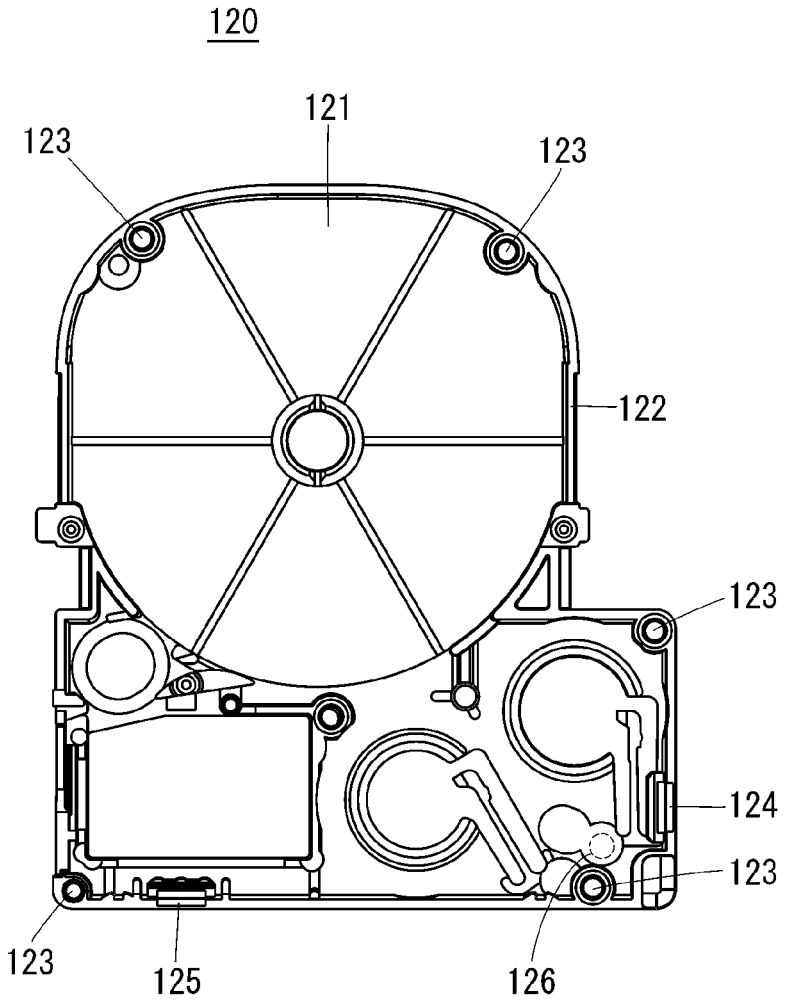
FIG. 12 is a plan view of a second case of the tape cartridge shown in FIG. 8.

As shown in FIGS. 7 and 12, the second case 120 is provided with a second base portion 121 and a second peripheral wall portion 122. One or a plurality of case holes 126 are provided in a corner portion of the outer surface of the second base portion 121. A plurality of fitting holes 123, a first hook receiving portion 124, and a second hook receiving portion 125 are provided in the second peripheral wall portion 122. The fitting pins 113 are press-fitted into the fitting holes 123. The first hook 114 engages with the first hook receiving portion 124. The second hook 115 engages with the second hook receiving portion 125. In this manner, as a result of the fitting pins 113 being press-fitted into the fitting holes 123, the first hook 114 engaging with the first hook receiving portion 124, and the second hook 115 engaging with the second hook receiving portion 125, the first case 110 and the second case 120 are assembled, and the cartridge case 105 is formed.

The tape cartridge 100 is mounted in the cartridge mounting portion 5 in an orientation in which the first case 110 is in a top side in a mounting direction of the tape cartridge 100 and the second case 120 is the other side in the mounting direction of the tape cartridge 100. That is, the tape cartridge 100 is mounted in the cartridge mounting portion 5 so that the outer surface of the second base portion 121 of the second case 120 is in contact with the bottom surface of the cartridge mounting portion 5. Therefore, when the tape cartridge 100 is mounted in the cartridge mounting portion 5, each tip end of the fitting pins 113, the first hook 114, and the second hook 115 is directed toward the other side in the mounting direction of the tape cartridge 100.

With the exception of the dimension (the thickness) in the mounting direction of the tape cartridge 100, the cartridge case 105 is configured in a substantially similar manner between a plurality of types of tape cartridge 100, but the depths of the recessed parts of the first base-end-side part 116, the depths of the o recessed parts f the second base-end-side part 117, and the pattern of the case holes 126 is different.

The depth of the recessed parts of the first base-end-side part 116, that is, the dimension in the thickness direction of the first peripheral wall portion 112 from the outer surface of the first base-end-side part 116 up to the outer surface of a peripheral edge portion of the first base-end-side part 116 are different for two types of tape cartridge 100 in terms of the cutting suitability. More specifically, the depths of the recessed parts of the first base-end-side part 116 is the first depth (refer to FIGS. 3, 4, and 6) in a tape cartridge 100 for which the cutting suitability is not suited to cutting, and is the second depth (refer to FIGS. 8, 9, and 11), which is shallower than the first depth in a tape cartridge 100 for which the cutting suitability is suited to cutting. In this instance, a first base-end-side part 116 for which the depths of the recessed parts is the first depth is configured by a groove form concave portion that spans the entire attachment and detachment direction of the tape cartridge 100. Additionally, the cross-sectional shape of the concave portion is not particularly limited, and for example, may be circular or rectangular. Meanwhile, a first base-end-side part 116 for which the depths of the recessed parts is the second depth is configured by a substantially flat surface. That is, the second depth is substantially zero. Naturally, a first base-end-side part 116 for which the depths of the recessed parts is the second depth may also be configured by a concave portion. In this manner, as long as the second depth is a value that is smaller than the first depth, the second depth may be zero but need not necessarily be zero.

In addition, the depths of the recessed parts of the second base-end-side part 117, that is, the dimension in the thickness direction of the first peripheral wall portion 112 from the outer surface of the second base-end-side part 117 up to the outer surface of a peripheral edge portion of the second base-end-side part 117 are different for two types of tape cartridge 100 in terms of the temperature property. More specifically, the depths of the recessed parts of the second base-end-side part 117 is a third depth (refer to FIGS. 3 to 5) in a tape cartridge 100 for which the temperature property is the first temperature, and is a fourth depth (refer to FIGS. 8 to 10), which is shallower than the third depth in a tape cartridge 100 for which the temperature property is the second temperature. In this instance, a second base-end-side part 117 for which the depths of the recessed parts is the third depth is configured by a groove form concave portion that spans the entire attachment and detachment direction of the tape cartridge 100. Additionally, the cross-sectional shape of the concave portion is not particularly limited, and for example, may be circular or rectangular. Meanwhile, a second base-end-side part 117 for which the depths of the recessed parts is the fourth depth is configured by a substantially flat surface. That is, the fourth depth is substantially zero. Naturally, a second base-end-side part 117 for which the depths of the recessed parts is the fourth depth may also be configured by a concave portion. In this manner, as long as the fourth depth is a value that is smaller than the third depth, the fourth depth may be zero but need not necessarily be zero. Additionally, the third depth may be the same as or be different from the first depth, and the fourth depth may be the same as or may be different from the second depth.

Furthermore, the pattern of the case holes 126, that is, the combination of the presence or absence of the case holes 126 in a plurality of locations (three locations in this instance) is different for a plurality of types of tape cartridge 100 having different tape widths. More specifically, the pattern of the case holes 126 is a first pattern (refer to FIG. 7) in a tape cartridge 100 in which the tape width is the first width, and is a second pattern (refer to FIG. 12), which is different from the first pattern, in a tape cartridge 100 in which the tape width is the second width.

Figure 13:
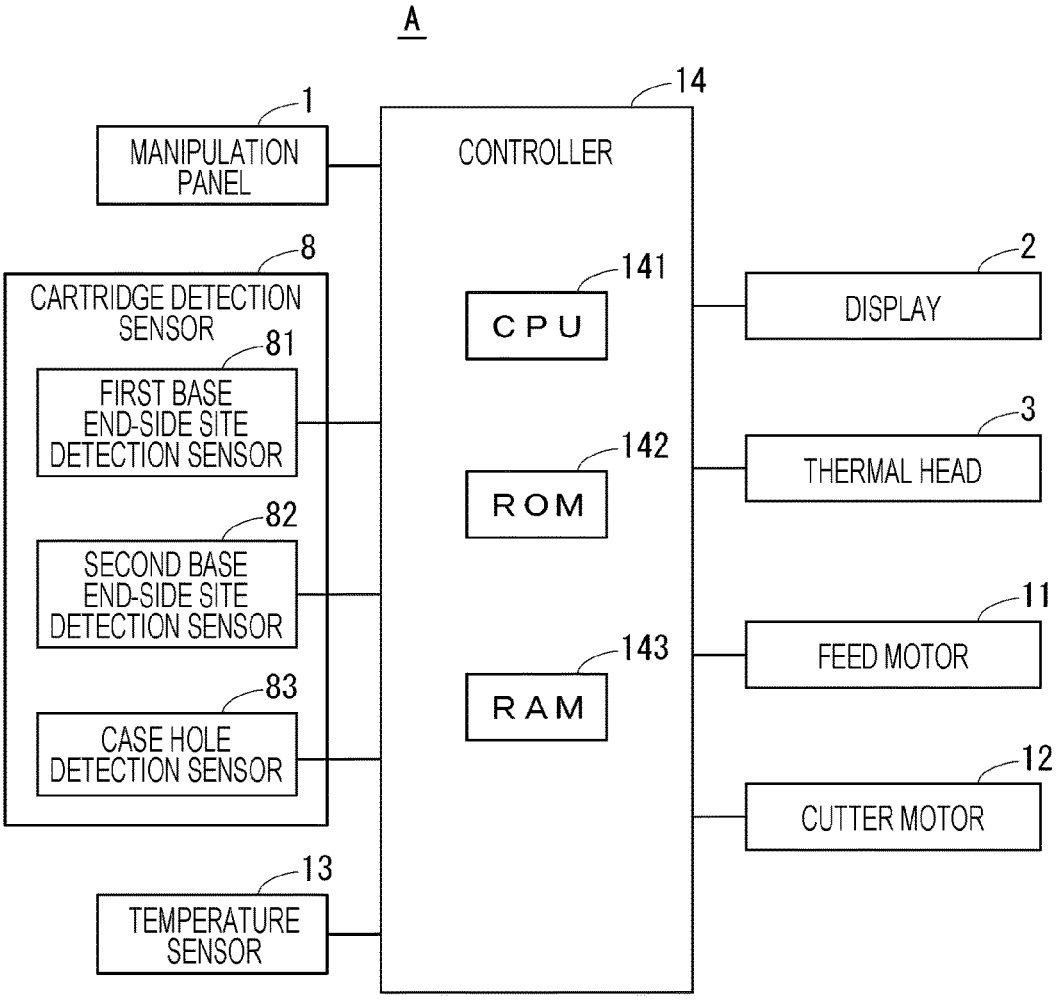
FIG. 13 is a block diagram that shows a control configuration of the tape printing apparatus.

A control configuration of the tape printing apparatus A will be described below on the basis of FIG. 13. In addition to the manipulation panel 1, the display 2, the thermal head 3, and the cartridge detection sensor 8 that are mentioned above, the tape printing apparatus A is provided with a feed motor 11, a cutter motor 12, a temperature sensor 13, and a controller 14.

The feed motor 11 is a drive source that causes the platen rotor 53 and the wind-up rotor 54 to rotate. The cutter motor 12 is a drive source that causes the cutter 4 to perform a cutting operation. Additionally, the feed motor 11 and the cutter motor 12 may be configured by a single motor in which both functions are combined.

The temperature sensor 13 is incorporated in the thermal head 3, and detects a heat generation temperature of the thermal head 3. For example, it is possible to use a thermistor as the temperature sensor 13.

The controller 14 is provided with a Central Processing Unit (CPU) 141, a Read Only Memory (ROM) 142, and a Random Access Memory (RAM) 143. The CPU 141 executes a program stored in the ROM 142 using the RAM 143. The controller 14 outputs a control signal to a driver circuit (not illustrated in the drawings) that drives the display 2, the thermal head 3, the feed motor 11, and the cutter motor 12. In addition, outputs from the manipulation panel 1, the first base-end-side part detection sensor 81, the second base-end-side part detection sensor 82, the case hole detection sensor 83, and the temperature sensor 13 are input to the controller 14.

The controller 14 determines, for a tape cartridge 100 mounted in the cartridge mounting portion 5, the type in terms of the cutting suitability on the basis of the output of the first base-end-side part detection sensor 81. That is, as will be mentioned in detail later, the output of the first base-end-side part detection sensor 81 changes depending on the depths of the recessed parts of the first base-end-side part 116 of a tape cartridge 100 mounted in the cartridge mounting portion 5. Therefore, in a case in which a tape cartridge 100 for which the depths of the recessed parts of the first base-end-side part 116 is the first depth is mounted in the cartridge mounting portion 5, the controller 14 determines that the tape cartridge 100 is a tape cartridge 100 for which the cutting suitability is not suited to cutting. In addition, in a case in which a tape cartridge 100 for which the depths of the recessed parts of the first base-end-side part 116 is the second depth is mounted in the cartridge mounting portion 5, the controller 14 determines that the tape cartridge 100 is a tape cartridge 100 for which the cutting suitability is suited to cutting.

The controller 14 determines, for a tape cartridge 100 mounted in the cartridge mounting portion 5, the type in terms of the temperature property on the basis of the output of the second base-end-side part detection sensor 82. That is, as will be mentioned in detail later, the output of the second base-end-side part detection sensor 82 changes depending on the depths of the recessed parts of the second base-end-side part 117 of a tape cartridge 100 mounted in the cartridge mounting portion 5. Therefore, in a case in which a tape cartridge 100 for which the depths of the recessed parts of the second base-end-side part 117 is the third depth is mounted in the cartridge mounting portion 5, the controller 14 determines that the tape cartridge 100 is a tape cartridge 100 for which the temperature property is the first temperature. In addition, in a case in which a tape cartridge 100 for which the depths of the recessed parts of the second base-end-side part 117 is the fourth depth is mounted in the cartridge mounting portion 5, the controller 14 determines that the tape cartridge 100 is a tape cartridge 100 for which the temperature property is the second temperature.

The controller 14 determines, for a tape cartridge 100 mounted in the cartridge mounting portion 5, the type in terms of the tape width on the basis of the output of the case hole detection sensor 83. That is, the case hole detection sensor 83 is provided with a plurality (three in FIG. 2) of hole detection switches 83*a*. For example, it is possible to use microswitches as the hole detection switches 83*a*. The output of the case hole detection sensor 83, that is, the combination of the outputs (ON and OFF) of the plurality of hole detection switches 83*a* changes depending on the pattern of the case holes 126 of a tape cartridge 100 mounted in the cartridge mounting portion 5. Therefore, for example, in a case in which a tape cartridge 100 for which the pattern of the case holes 126 is the first pattern is mounted in the cartridge mounting portion 5, the controller 14 determines that the tape cartridge 100 is a tape cartridge 100 having the first width. In addition, in a case in which a tape cartridge 100 for which the pattern of the case holes 126 is the second pattern is mounted in the cartridge mounting portion 5, the controller 14 determines that the tape cartridge 100 is a tape cartridge 100 having the second width.

The controller 14 controls the thermal head 3 on the basis of the output of the temperature sensor 13 so that the heat generation temperature of the thermal head 3 is a desired temperature (the first temperature or the second temperature).

The first base-end-side part detection sensor 81 will be described below on the basis of FIGS. 14 to 16. Additionally, since the second base-end-side part detection sensor 82 is configured in a similar manner to the first base-end-side part detection sensor 81, in this instance, description thereof will be omitted.

The first base-end-side part detection sensor 81 is provided on an inner peripheral surface of the cartridge mounting portion 5 in a manner that faces the first base-end-side part 116 in a state in which a tape cartridge 100 is mounted in the cartridge mounting portion 5. The first base-end-side part detection sensor 81 is provided with a sensor case 811 and a rod-shaped detecting device 812. A sensor circuit which is not illustrated in the drawings is built into the sensor case 811. In addition, a support shaft 813 that is parallel a Y axis is fixed to the sensor case 811. The detecting device 812 is provided on the support shaft 813 in a rotatable manner at one end portion (+X side), and the other end portion (−X side) projects from the inner peripheral surface of the cartridge mounting portion 5. That is, the detecting device 812 is biased toward a position that is parallel to the X axis by a spring, for example, and is capable of rotating, from the position that is parallel to the X axis, in the mounting direction (−Z direction) and the detachment direction (+Z direction) of the tape cartridge 100 with the support shaft 813 as the center thereof.

In this instance, relating to the detecting device 812, a position that is parallel to the X axis is referred to as a first position, and a position that is rotated from the position that is parallel to the X axis by a predetermined angle in the mounting direction (−Z direction) of the tape cartridge 100 is referred to as a second position. In the first base-end-side part detection sensor 81, the output are different for a state in which the detecting device 812 is in positioned in the first position and a state in which the detecting device 812 is positioned in the second position. For example, the first base-end-side part detection sensor 81 outputs OFF in a state in which the detecting device 812 is positioned in the first position, outputs OFF in a state in which the detecting device 812 is positioned in the second position, and the ON and OFF may be reversed. Additionally, for example, it is possible to use a microswitch as the first base-end-side part detection sensor 81.

Figure 14:
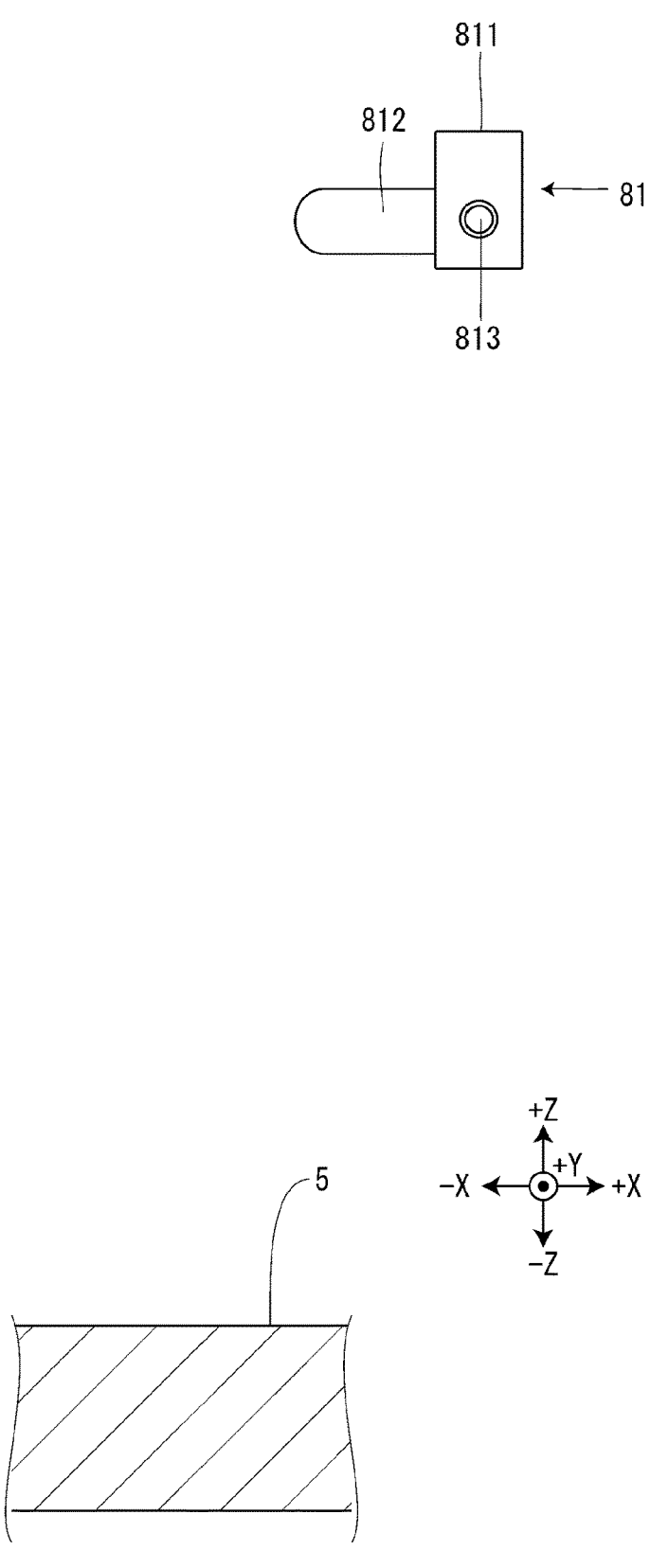
FIG. 14 is a view that shows a first base-end-side part detection sensor in a state in which a tape cartridge is not mounted in the cartridge mounting portion.

As shown in FIG. 14, in a state in which a tape cartridge 100 is not mounted in the cartridge mounting portion 5, the detecting device 812 is positioned in the first position. At this time, the first base-end-side part detection sensor 81 outputs OFF since the detecting device 812 is positioned in the first position.

Figure 15:
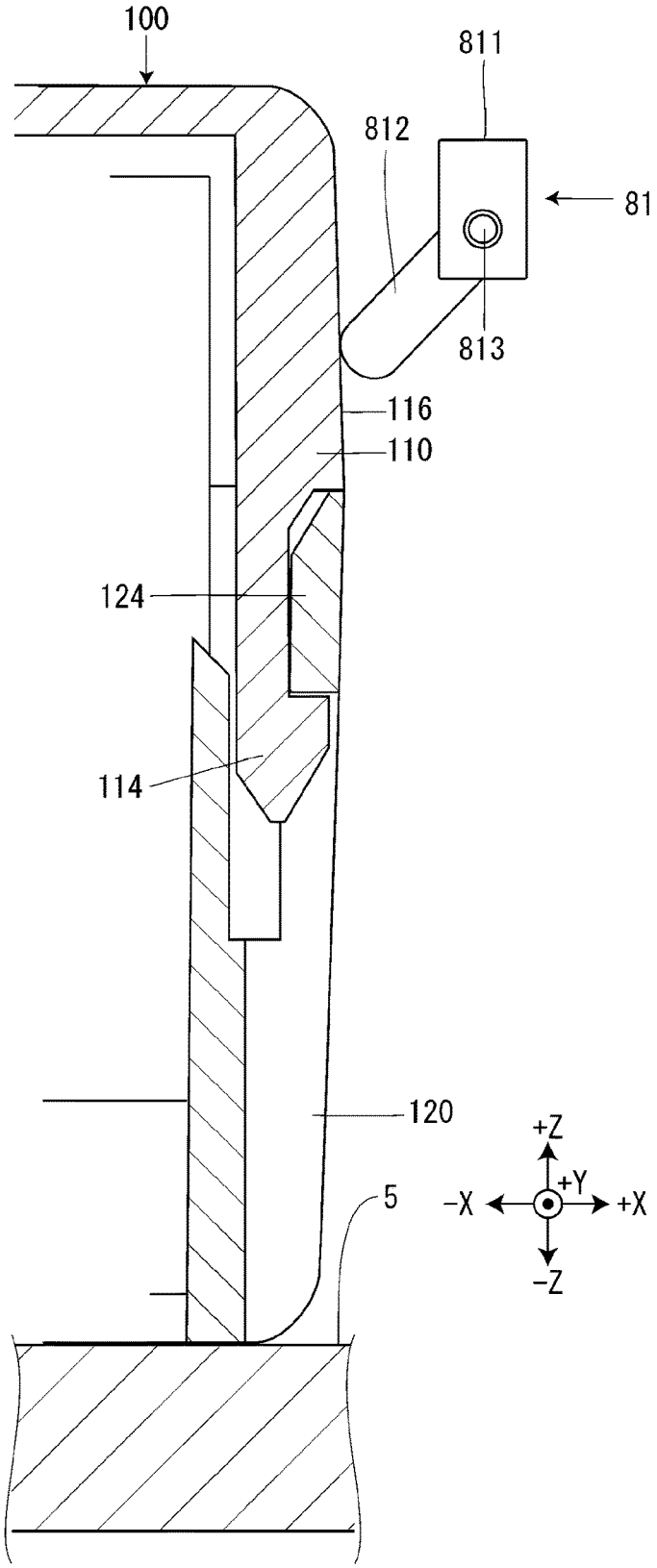
FIG. 15 is a view that shows a first base-end-side part detection sensor in a state in which the tape cartridge shown in FIG. 8 is mounted in the cartridge mounting portion.

In addition, as shown in FIG. 15, when the tape cartridge 100 shown in FIG. 8, that is, a tape cartridge 100 for which the depths of the recessed parts of the first base-end-side part 116 is the second depth, is mounted in the cartridge mounting portion 5, the detecting device 812 comes into contact with the first hook receiving portion 124 during mounting, and rotates in the mounting direction (−Z direction) of the tape cartridge 100 from the first position toward the second position. Further, in a state in which such a tape cartridge 100 is mounted in the cartridge mounting portion 5, the detecting device 812 is positioned in the second position since the detecting device 812 comes into contact with the first hook receiving portion 124 and then the first base-end-side part 116. At this time, the first base-end-side part detection sensor 81 outputs ON since the detecting device 812 is positioned in the second position.

Figure 16:
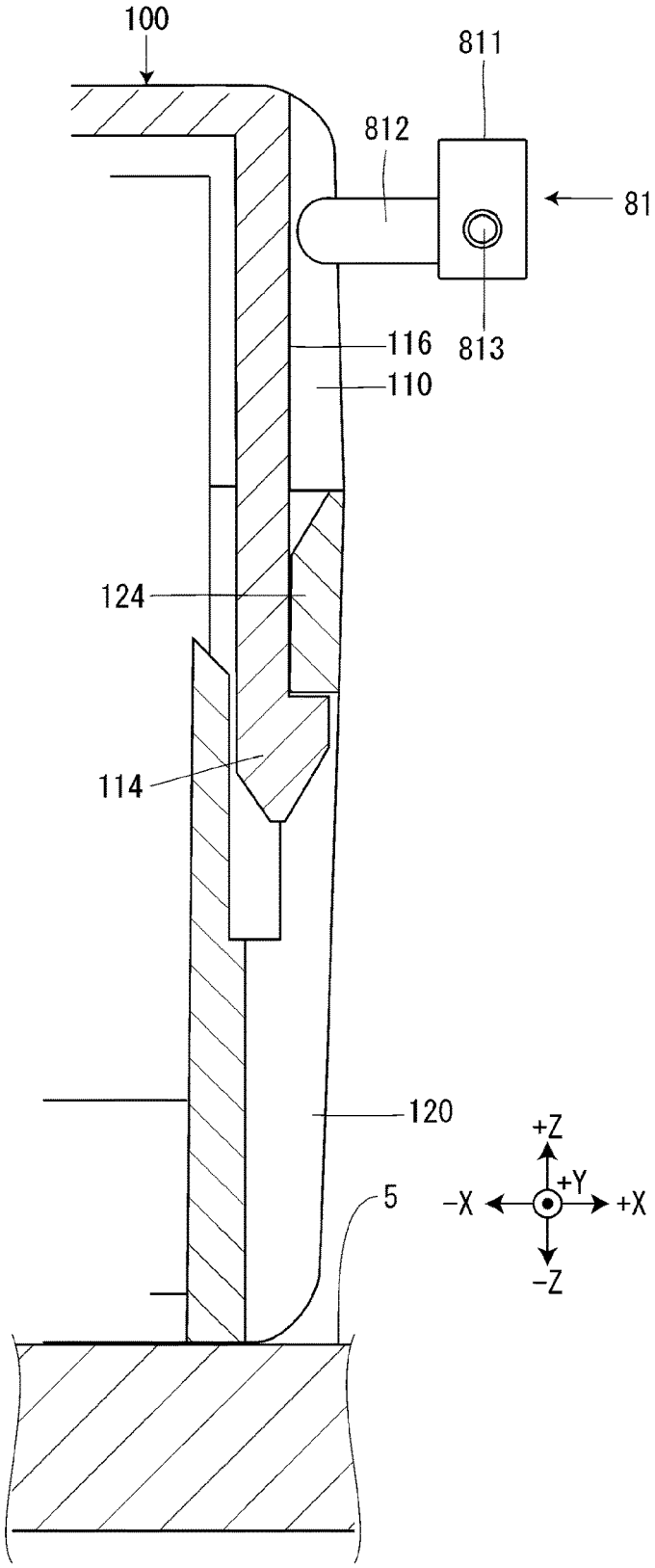
FIG. 16 is a view that shows a first base-end-side part detection sensor in a state in which the tape cartridge shown in FIG. 3 is mounted in the cartridge mounting portion.

Meanwhile, as shown in FIG. 16, when the tape cartridge 100 shown in FIG. 3, that is, a tape cartridge 100 for which the depths of the recessed parts of the first base-end-side part 116 is the first depth, is mounted in the cartridge mounting portion 5, the detecting device 812 comes into contact with the first hook receiving portion 124 during mounting, and rotates in the mounting direction of the tape cartridge 100 from the first position toward the second position. However, in a state in which such a tape cartridge 100 is mounted in the cartridge mounting portion 5, the detecting device 812 is positioned in the first position since the detecting device 812 faces the first base-end-side part 116 but does not come into contact therewith. That is, the detecting device 812 that comes into contact with the first hook receiving portion 124 and is rotated from the first position toward the second position rotates in the reverse direction to the first position when contact with the first hook receiving portion 124 is released. At this time, the first base-end-side part detection sensor 81 outputs OFF since the detecting device 812 is positioned in the first position.

Additionally, in a case in which a tape cartridge 100 for which the depths of the recessed parts of the first base-end-side part 116 is the first depth is mounted in the cartridge mounting portion 5, when the tape cartridge 100 is detached from the cartridge mounting portion 5, in the first hook receiving portion 124, an end surface on the other side (+Z side) in the detachment direction of the tape cartridge 100 touches the detecting device 812, but the detecting device 812 rotates in the detachment direction (+Z direction) of the tape cartridge 100. Therefore, when the tape cartridge 100 is detached from the cartridge mounting portion 5, it is possible to suppress a circumstance in which the detecting device 812 becomes an obstruction, the tape cartridge 100 cannot be detached, the detecting device 812 is broken, or the like.

Figure 17:
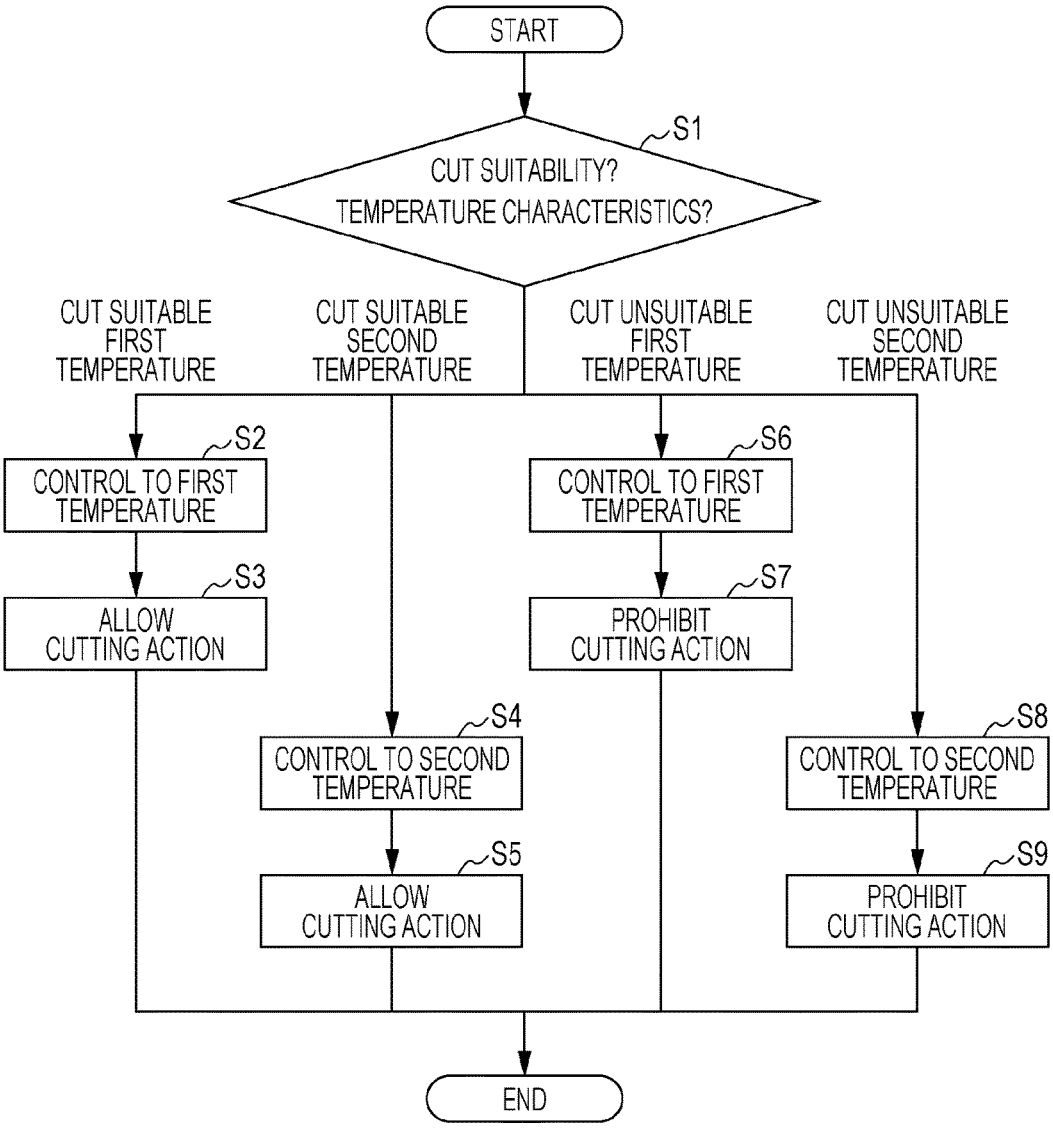
FIG. 17 is a flowchart that shows a flow of a printing control process that a controller executes.

A flow of a printing control process that the controller 14 executes will be described below on the basis of FIG. 17. The controller 14 executes the printing control process in a case in which it is detected that a printing button has been pushed, or the like.

In Step S1, the controller 14 determines, for a tape cartridge 100 mounted in the cartridge mounting portion 5, the type in terms of the cutting suitability on the basis of the output of the first base-end-side part detection sensor 81. In addition, the controller 14 determines, for a tape cartridge 100 mounted in the cartridge mounting portion 5, the type in terms of the temperature property on the basis of the output of the second base-end-side part detection sensor 82.

In a case in which it was determined in Step S1 that the tape cartridge 100 mounted in the cartridge mounting portion 5 is a tape cartridge 100 for which the cutting suitability is suited to cutting and the temperature property is the first temperature, the controller 14 advances the process to Step S2.

In Step S2, the controller 14 controls the thermal head 3 so that the heat generation temperature of the thermal head 3 is the first temperature. The process proceeds to Step S3, and the controller 14 allows the cutting operation of the cutter 4.

In a case in which it was determined in Step S1 that the tape cartridge 100 mounted in the cartridge mounting portion 5 is a tape cartridge 100 for which the cutting suitability is suited to cutting and the temperature property is the second temperature, the controller 14 advances the process to Step S4.

In Step S4, the controller 14 controls the thermal head 3 so that the heat generation temperature of the thermal head 3 is the second temperature. The process proceeds to Step S5, and the controller 14 allows the cutting operation of the cutter 4.

In a case in which it was determined in Step S1 that the tape cartridge 100 mounted in the cartridge mounting portion 5 is a tape cartridge 100 for which the cutting suitability is not suited to cutting and the temperature property is the first temperature, the controller 14 advances the process to Step S6.

In Step S6, the controller 14 controls the thermal head 3 so that the heat generation temperature of the thermal head 3 is the first temperature. The process proceeds to Step S7, and the controller 14 prohibits the cutting operation of the cutter 4.

In a case in which it was determined in Step S1 that the tape cartridge 100 mounted in the cartridge mounting portion 5 is a tape cartridge 100 for which the cutting suitability is not suited to cutting and the temperature property is the second temperature, the controller 14 advances the process to Step S8.

In Step S8, the controller 14 controls the thermal head 3 so that the heat generation temperature of the thermal head 3 is the second temperature. The process proceeds to Step S9, and the controller 14 prohibits the cutting operation of the cutter 4.

In this manner, in a case in which a tape cartridge 100 for which the cutting suitability is suited to cutting, that is, a tape cartridge 100 for which the depths of the recessed parts of the first base-end-side part 116 is the second depth, is mounted in the cartridge mounting portion 5, the controller 14 allows the cutting operation of the cutter 4. Meanwhile, in a case in which a tape cartridge 100 for which the cutting suitability is not suited to cutting, that is, a tape cartridge 100 for which the depths of the recessed parts of the first base-end-side part 116 is the first depth, is mounted in the cartridge mounting portion 5, the controller 14 prohibits the cutting operation of the cutter 4. As a result of this, even if a user does not perform setting of whether or not to perform cutting of the tape T during printing from the manipulation panel 1, or the like, prior to the execution of printing to match the cutting suitability of the tape cartridge 100 mounted in the cartridge mounting portion 5, it is possible to suppress the cutting operation of the cutter 4 from being performed in a case in which a tape cartridge 100 for which the cutting suitability is not suited to cutting is mounted in the cartridge mounting portion 5. Accordingly, it is possible to suppress a circumstance in which the tape T is not cut properly, the cutter motor 12 is overloaded, a blade of the cutter 4 is chipped, or the like, due to the cutter 4 performing the cutting operation on the tape T of a tape cartridge 100 for which the cutting suitability is not suited to cutting.

In addition, in a case in which a tape cartridge 100 for which the temperature property is the first temperature, that is, a tape cartridge 100 for which the depths of the recessed parts of the second base-end-side part 117 is the third depth, is mounted in the cartridge mounting portion 5, the controller 14 controls the thermal head 3 so that the heat generation temperature is the first temperature. Meanwhile, in a case in which a tape cartridge 100 for which the temperature property is the second temperature, that is, a tape cartridge 100 for which the depths of the recessed parts of the second base-end-side part 117 is the fourth depth, is mounted in the cartridge mounting portion 5, the controller 14 controls the thermal head 3 so that the heat generation temperature is the second temperature. As a result of this, even if a user does not perform setting of the heat generation temperature of the thermal head 3 from the manipulation panel 1, or the like, prior to the execution of printing to match the temperature property of the tape cartridge 100 mounted in the cartridge mounting portion 5, it is possible to automatically perform printing at a heat generation temperature of the thermal head 3 that is suited to temperature property of the tape cartridge 100 mounted in the cartridge mounting portion 5. Accordingly, printing is performed on the tape T at an appropriate printing concentration, and it is possible to suppress a circumstance in which printed characters are crushed, blurred, or the like.

In the above-mentioned manner, the tape printing apparatus A of the present embodiment is provided with the cartridge mounting portion 5, the first base-end-side part detection sensor 81, and the second base-end-side part detection sensor 82. The tape cartridge 100 is mounted in the cartridge mounting portion 5. The tape cartridge 100 is provided with the first case 110 and the second case 120. The first case 110 includes the first peripheral wall portion 112 in which the first hook 114 and the second hook 115 project from the tip end surface 112*a*. On the outer peripheral surface 112*b* of the first peripheral wall portion 112, the depths of the recessed parts of the first base-end-side part 116, which is a site that is further on the base end side than a base end portion of the first hook 114, are different for two types of tape cartridge 100 in terms of cutting suitability. On the outer peripheral surface 112*b* of the first peripheral wall portion 112, the depths of the recessed parts of the second base-end-side part 117, which is a site that is further on the base end side than a base end portion of the second hook 115, are different for two types of tape cartridge 100 in terms of temperature property. The second case 120 includes the first hook receiving portion 124 with which the first hook 114 engages and the second hook receiving portion 125 with which the second hook 115 engages. In the first base-end-side part detection sensor 81, the output changes depending on the depths of the recessed parts of the first base-end-side part 116 in a state in which the tape cartridge 100 is mounted in the cartridge mounting portion 5. In the second base-end-side part detection sensor 82, the output changes depending on the depths of the recessed parts of the second base-end-side part 117 in a state in which the tape cartridge 100 is mounted in the cartridge mounting portion 5.

According to this configuration, the output of the first base-end-side part detection sensor 81 changes depending on the depths of the recessed parts of the first base-end-side part 116 of the tape cartridge 100 mounted in the cartridge mounting portion 5, and the output of the second base-end-side part detection sensor 82 changes depending on the depths of the recessed parts of the second base-end-side part 117 thereof. As a result of this, in a case in which a tape cartridge 100 for which the depths of the recessed parts of the first base-end-side part 116 are different for two types of tape cartridge 100 in terms of cutting suitability, and for which the depths of the recessed parts of the second base-end-side part 117 are different for two types of tape cartridge 100 in terms of temperature property is mounted, it is possible to detect the type of the tape cartridge 100 in terms of the cutting suitability and the type of the tape cartridge 100 in terms of temperature property. In addition, since it is possible to detect the types of a plurality of tape cartridges 100 by changing the depths of the recessed parts of the first base-end-side part 116 and the second base-end-side part 117, which are configurations for forming the cartridge case 105, even if the number of the case holes 126 is not increased, it is possible to increase the number of types of tape cartridge 100 that it is possible to detect.

A modification example of the first base-end-side part detection sensor 81 will be described below on the basis of FIGS. 18 to 20. This modification example can also be applied to the second base-end-side part detection sensor 82. Additionally, in the modification example, content that is similar to that of the above-mentioned embodiment will be omitted as appropriate, and description will be given focusing on the differences from the above-mentioned embodiment.

The detecting device 812 of the first base-end-side part detection sensor 81 according to the modification example is provided in the sensor case 811 in a manner in which advancement and retraction is possible in a direction (X direction) that intersects the attachment and detachment direction (Z direction) of the tape cartridge 100. That is, the detecting device 812 is biased toward a position of projecting from the inner peripheral surface of the cartridge mounting portion 5 by a spring, for example, and is capable of retracting in the direction (+X direction) that intersects the attachment and detachment direction (Z direction) of the tape cartridge 100 from the position.

In this instance, relating to the detecting device 812, a position of projecting from the inner peripheral surface of the cartridge mounting portion 5 is referred to as an protruding position, and a position that is retracted from the protruding position in the direction that intersects the attachment and detachment direction of the tape cartridge 100 is referred to as a depressed position. In the first base-end-side part detection sensor 81, the output are different for a state in which the detecting device 812 is in positioned in the protruding position and a state in which the detecting device 812 is positioned in the depressed position. For example, the first base-end-side part detection sensor 81 outputs OFF in a state in which the detecting device 812 is positioned in the protruding position, outputs OFF in a state in which the detecting device 812 is positioned in the depressed position, and the ON and OFF may be reversed.

Figure 18:
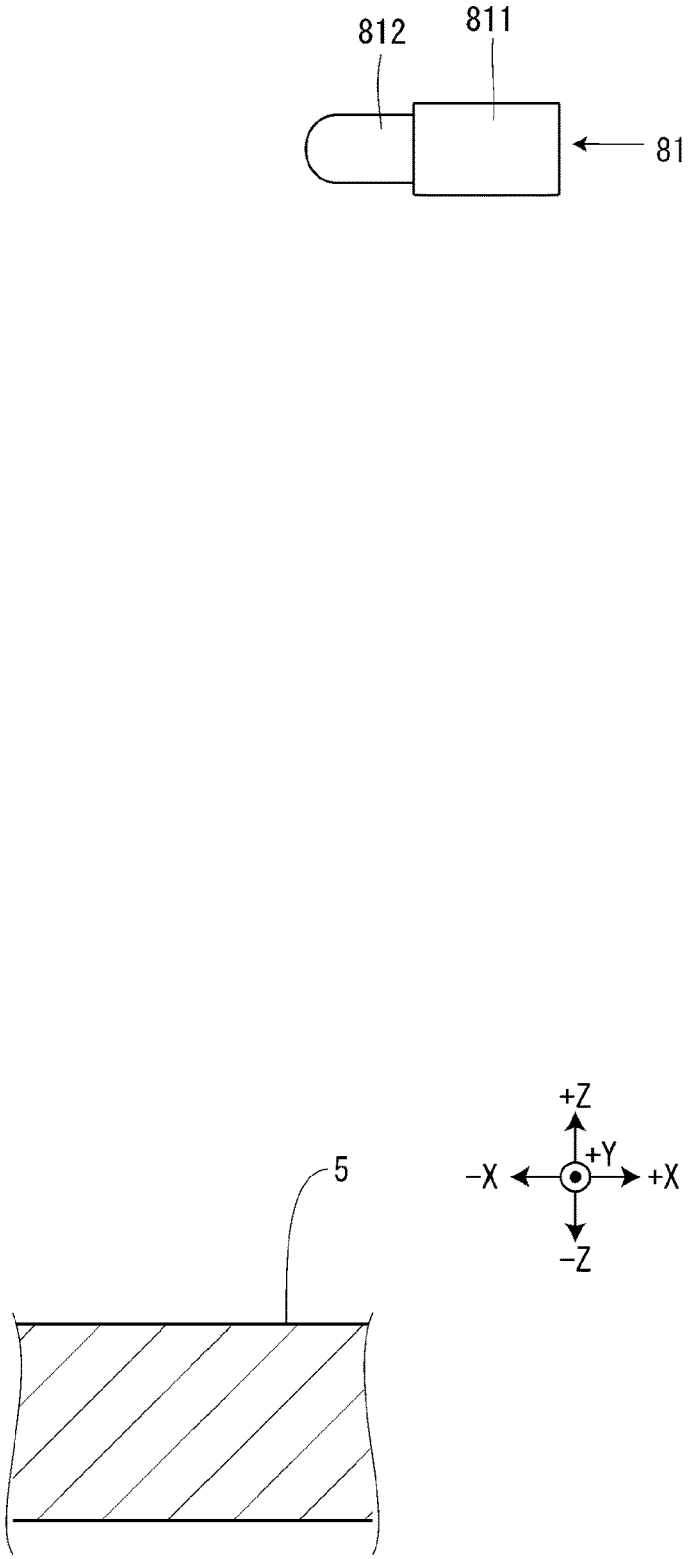
FIG. 18 is a view that shows a first base-end-side part detection sensor, which is a modification example of the first base-end-side part detection sensor, in a state in which a tape cartridge is not mounted in the cartridge mounting portion.

As shown in FIG. 18, in a state in which a tape cartridge 100 is not mounted in the cartridge mounting portion 5, the detecting device 812 is positioned in the protruding position. At this time, the first base-end-side part detection sensor 81 outputs OFF since the detecting device 812 is positioned in the protruding position.

Figure 19:
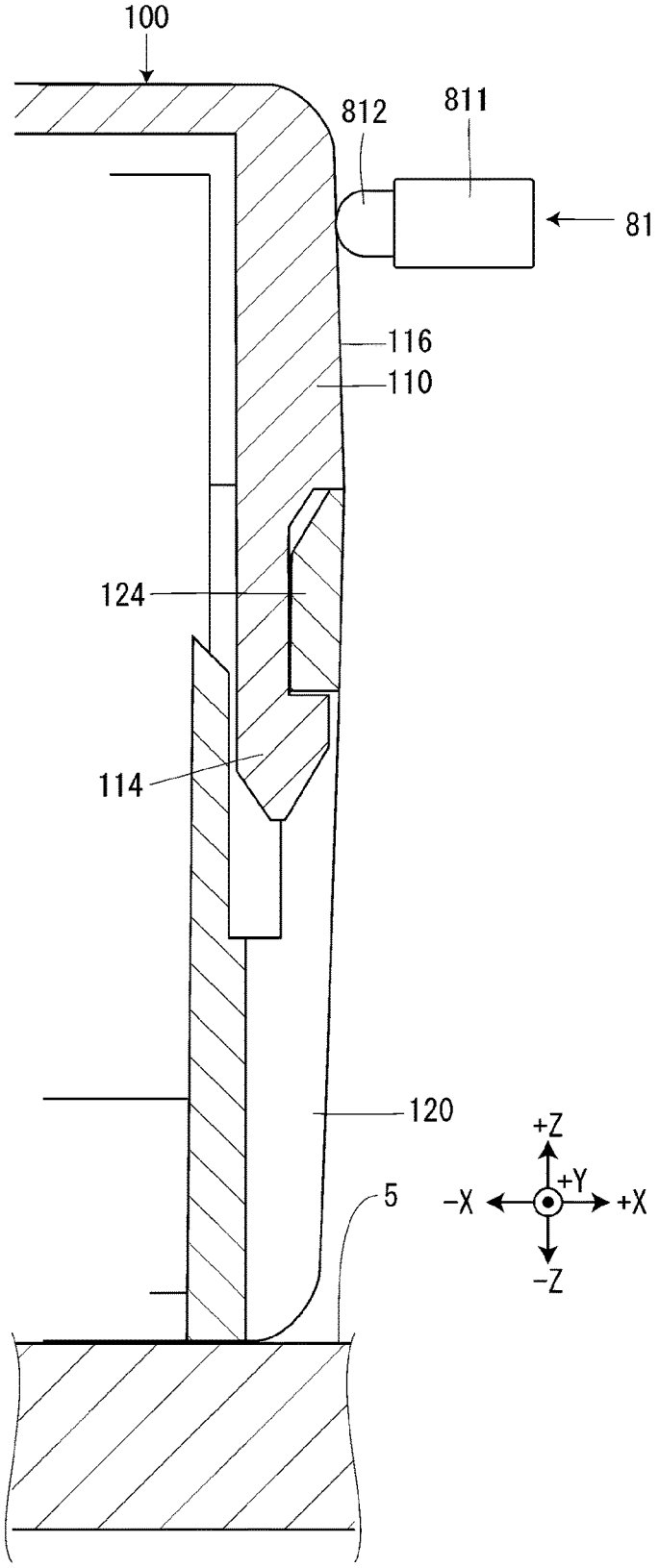
FIG. 19 is a view that shows the first base-end-side part detection sensor, which is a modification example of the first base-end-side part detection sensor, in a state in which the tape cartridge shown in FIG. 8 is mounted in the cartridge mounting portion.

In addition, as shown in FIG. 19, when a tape cartridge 100 for which the depths of the recessed parts of the first base-end-side part 116 is the second depth is mounted in the cartridge mounting portion 5, the detecting device 812 comes into contact with the first hook receiving portion 124 during mounting, and retracts in the direction (+X direction) that intersects the attachment and detachment direction (Z direction) of the tape cartridge 100 from the protruding position toward the depressed position. Further, in a state in which such a tape cartridge 100 is mounted in the cartridge mounting portion 5, the detecting device 812 is positioned in the depressed position since the detecting device 812 comes into contact with the first hook receiving portion 124 and then the first base-end-side part 116. At this time, the first base-end-side part detection sensor 81 outputs ON since the detecting device 812 is positioned in the depressed position.

Figure 20:
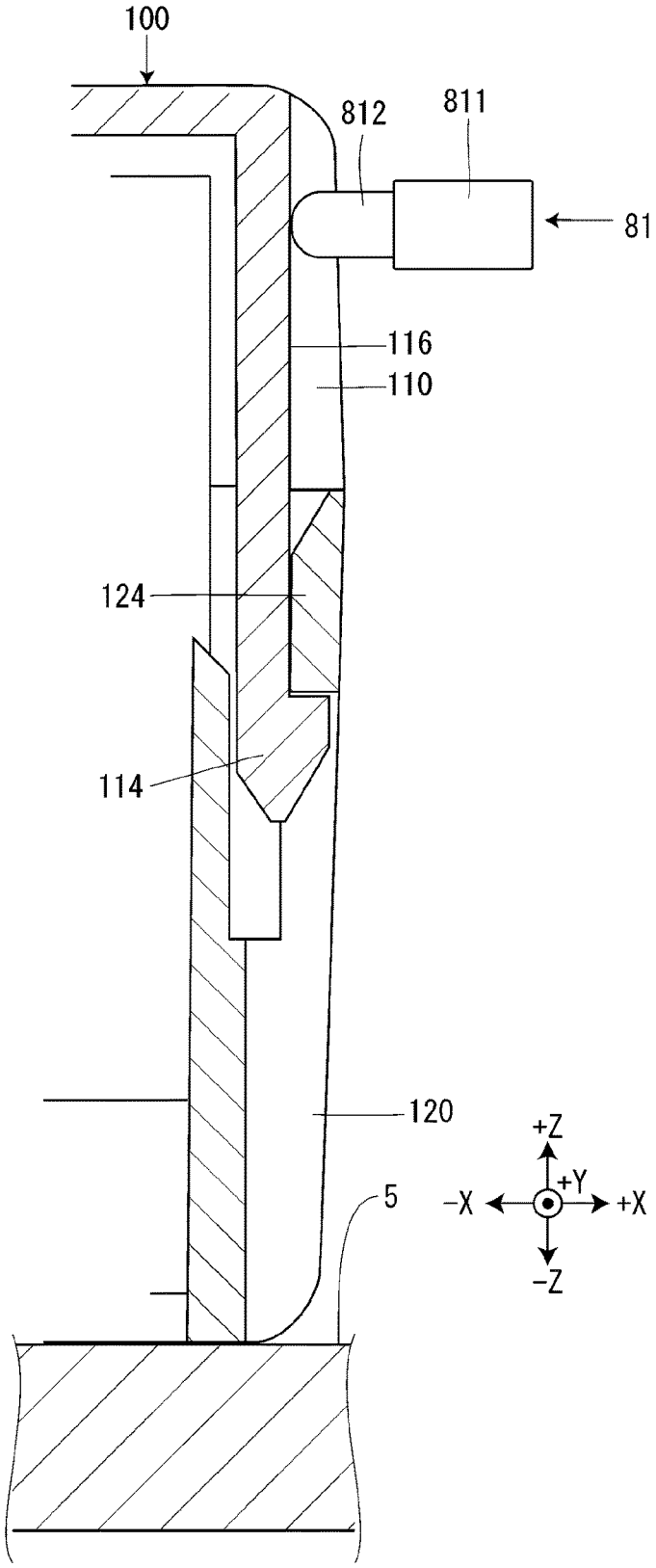
FIG. 20 is a view that shows the first base-end-side part detection sensor, which is a modification example of the first base-end-side part detection sensor, in a state in which the tape cartridge shown in FIG. 3 is mounted in the cartridge mounting portion.

Meanwhile, as shown in FIG. 20, when a tape cartridge 100 for which the depths of the recessed parts of the first base-end-side part 116 is the first depth is mounted in the cartridge mounting portion 5, the detecting device 812 comes into contact with the first hook receiving portion 124 during mounting, and retracts in the direction (+X direction) that intersects the attachment and detachment direction (Z direction) of the tape cartridge 100 from the protruding position toward the depressed position. However, in a state in which such a tape cartridge 100 is mounted in the cartridge mounting portion 5, the detecting device 812 is positioned in the protruding position since the detecting device 812 faces the first base-end-side part 116 but does not come into contact therewith. That is, the detecting device 812 that comes into contact with the first hook receiving portion 124 and is retracted from the protruding position toward the depressed position advances so as to return to the protruding position when contact with the first hook receiving portion 124 is released. At this time, the first base-end-side part detection sensor 81 outputs OFF since the detecting device 812 is positioned in the protruding position.

Additionally, in a case in which a tape cartridge 100 for which the depths of the recessed parts of the first base-end-side part 116 is the first depth is mounted in the cartridge mounting portion 5, when the tape cartridge 100 is detached from the cartridge mounting portion 5, the detecting device 812 touches, of the first hook receiving portion 124, an end surface on the other side (+Z side) in the detachment direction of the tape cartridge 100. Therefore, when the tape cartridge 100 is detached from the cartridge mounting portion 5, there is a concern that the detecting device 812 will become an obstruction, it will not possible to detach the tape cartridge 100, the detecting device 812 will be broken, or the like. In such an instance, of the first hook receiving portion 124, the end surface on the other side (+Z side) in the detachment direction of the tape cartridge 100 may be an inclined surface that is inclined in the mounting direction (−Z direction) of the tape cartridge 100 toward the outer side (+X side) of the second peripheral wall portion 122. When the tape cartridge 100 is detached from the cartridge mounting portion 5, the detecting device 812 retracts from the protruding position to the depressed position when the detecting device 812 touches the inclined surface. Therefore, when the tape cartridge 100 is detached from the cartridge mounting portion 5, the detecting device 812 is suppressed from becoming an obstruction, or the like. The same applies to the second hook receiving portion 125.

In this manner, in the first base-end-side part detection sensor 81 according to the modification example, the output also changes depending on the depths of the recessed parts of the first base-end-side part 116 in a state in which the tape cartridge 100 is mounted in the cartridge mounting portion 5.

Additionally, the first hook 114 and the second hook 115 are an example of "hooks". The first base-end-side part 116 and the second base-end-side part 117 are an example of "base-end-side parts". The first hook receiving portion 124 and the second hook receiving portion 125 are an example of "hook receiving portions". The first base-end-side part detection sensor 81 and the second base-end-side part detection sensor 82 are an example of "detection portions". The controller 14 is an example of a "control unit".

The invention is not limited to the above-mentioned embodiment, and naturally, can adopt various configurations within a range that does not depart from the aim thereof. For example, in addition to the above-mentioned modification example, the embodiment can be altered to have a form such as that below.

The tape printing apparatus A is provided with the first base-end-side part detection sensor 81 and the second base-end-side part detection sensor 82 as two detection portions, but the number of detection portions is not particularly limited, and may be one. That is, the tape printing apparatus A may have a configuration that is provided with either one of the first base-end-side part detection sensor 81 or the second base-end-side part detection sensor 82 only. In addition, the tape printing apparatus A may have a configuration that is provided with three or more detection portions.

The controller 14 is not limited to a configuration that determines the type of a tape cartridge 100 in terms of the cutting suitability on the basis of the output of the first base-end-side part detection sensor 81, and may determine the type of a tape cartridge 100 in terms of a property other than the cutting suitability. For example, the controller 14 may determine the type of a tape cartridge 100 in terms of the tape width, the color of the tape T, or the color of the ink ribbon R on the basis of the output of the first base-end-side part detection sensor 81. In this case, a configuration in which the depths of the recessed parts of the first base-end-side part 116 differ between a plurality of types of tape cartridge 100 in terms of a property other than the cutting suitability such as the tape width, the color of the tape T, or the color of the ink ribbon R is used. The same applies to the second base-end-side part detection sensor 82 and depth of the recessed parts of the second base-end-side part 117.

The controller 14 is not limited to a configuration that determines the type of the tape cartridge 100 in terms of one property (for example, the cutting suitability) by using the output of the first base-end-side part detection sensor 81 and determines the type of the tape cartridge 100 in terms of another property (for example, the temperature property) by using the output of the second base-end-side part detection sensor 82. That is, the controller 14 may determine the type of the tape cartridge 100 in terms of one property by using a combination of the output of the first base-end-side part detection sensor 81 and the output of the second base-end-side part detection sensor 82. This configuration is particularly effective in a case in which three or more types of tape cartridge 100 are available in terms of one property. In this case, a combination of the depths of the recessed parts of the first base-end-side part 116 and the depths of the recessed parts of the second base-end-side part 117 are different for a plurality of types of tape cartridge 100 in terms of one property.

The first base-end-side part detection sensor 81 is not limited to a configuration that switches the output in the two steps of ON and OFF, and may have a configuration that switches the output in three or more steps. According to this configuration, the controller 14 can determine the type of three or more tape cartridges 100 in terms of one or a plurality of properties on the basis of the output of the first base-end-side part detection sensor 81 only. In this case, the depths of the recessed parts of the first base-end-side part 116 are different for three or more types of tape cartridge 100 in terms of one or a plurality of properties. The same applies to the second base-end-side part detection sensor 82 and depth of the recessed parts of the second base-end-side part 117.

The first base-end-side part detection sensor 81 may be provided in the cover 6. According to this configuration, the opened cover 6 and the first base-end-side part detection sensor 81 are withdrawn from the cartridge mounting portion 5. Therefore, when the tape cartridge 100 is mounted or detached in/from the cartridge mounting portion 5, it is possible to suppress a circumstance in which the first base-end-side part detection sensor 81 becomes an obstruction, and the tape cartridge 100 cannot be mounted or detached. The same applies to the second base-end-side part detection sensor 82.

A microswitch is illustrated by way of example as the first base-end-side part detection sensor 81, but the invention is not limited to this configuration, and for example, may use an optical sensor. That is, a configuration in which the output of the optical sensor is different due to the amount of light that the optical sensor receives differing in accordance with the depths of the recessed parts of the first base-end-side part 116 may also be used. The same applies to the second base-end-side part detection sensor 82.

The tape printing apparatus A may have a configuration in which a user can set whether or not to perform cutting of the tape T during printing from the manipulation panel 1, for example, prior to the execution of printing. In this case, when the performance of cutting of the tape T during printing is set, the controller 14 causes the cutter 4 to perform the cutting operation in Step S3 or Step S5 shown in FIG. 17. Meanwhile, when non-performance of cutting of the tape T during printing is set, the controller 14 does not cause the cutter 4 to perform the cutting operation in Step S3 or Step S5. In addition, in a case in which it is determined, prior to the execution of printing, that the tape cartridge 100 mounted in the cartridge mounting portion 5 is a tape cartridge 100 for which the cutting suitability is suited to cutting, the controller 14 may configure such that it is not possible to for a user to set for the performance of cutting of the tape T during printing.

The controller 14 may report information related to the cutting suitability to a user on a report means such as the display 2 on the basis of the output of the first base-end-side part detection sensor 81. In a similar manner, the controller 14 may report information related to the temperature property to a user on the report means on the basis of the output of the second base-end-side part detection sensor 82.

The depth of the recessed parts of the first base-end-side part 116 is the first depth in a tape cartridge 100 for which the cutting suitability is not suited to cutting and is the second depth, which is shallower than the first depth, in a tape cartridge 100 for which the cutting suitability is suited to cutting, but these may be reversed. That is, the depths of the recessed parts of the first base-end-side part 116 may be the first depth in a tape cartridge 100 for which the cutting suitability is suited to cutting and may be the second depth in a tape cartridge 100 for which the cutting suitability is not suited to cutting.

This application claims priority under 35 U.S.C. § 119 to Japanese Patent Application No. 2017-038233,filed Mar. 1, 2017. The entire disclosure of Japanese Patent Application No. 2017-038233 is hereby incorporated herein by reference.

What is claimed is:

1. A tape printing apparatus comprising:

a cartridge mounting portion in which a tape cartridge is mounted, the tape cartridge including a first case that has a peripheral wall portion in which a hook projects from a tip end surface, and for which, on an outer peripheral surface of the peripheral wall portion, depths of recessed parts of a base-end-side part, which is a site that is further on a base end side than a base end portion of the hook, are different for a plurality of types of tape cartridge, and a second case that has a hook receiving portion with which the hook engages; and a detection portion, an output of which changes depending on the depths of the recessed parts at the base-end-side part in a state in which a tape cartridge is mounted in the cartridge mounting portion.

2. The tape printing apparatus according to claim 1, wherein the detection portion includes a detecting device that is positioned in a first position in a state in which a tape cartridge for which the depths of the recessed parts at the base-end-side part is a first depth is mounted in the cartridge mounting portion, and that is positioned in a second position, which is rotated from the first position in a mounting direction of a tape cartridge with a support shaft as the center thereof, in a state in which a tape cartridge for which the depths of the recessed parts at the base-end-side part is a second depth, which is shallower than the first depth, is mounted in the cartridge mounting portion, and in the detection portion, the output in a state in which the detecting device is positioned in the first position is different from the output in a state in which the detecting device is positioned in the second position.

3. The tape printing apparatus according to claim 1, wherein the detection portion includes a detecting device that is positioned in an protruding position in a state in which a tape cartridge for which the depths of the recessed parts at the base-end-side part is a first depth is mounted in the cartridge mounting portion, and that is positioned in a depressed position, which is retracted from the protruding position in a direction that intersects an attachment and detachment direction of tape cartridges, in a state in which a tape cartridge for which the depths of the recessed parts at the base-end-side part is a second depth, which is shallower than the first depth, is mounted in the cartridge mounting portion, and in the detection portion, the output in a state in which the detecting device is positioned in the protruding position is different from the output in a state in which the detecting device is positioned in the depressed position.

4. The tape printing apparatus according to claim 1, wherein a tape cartridge that has a plurality of the hooks, for which depths of recessed parts at one base-end-side part, which is a site that is further on a base end side than a base end portion of one hook, are different for a plurality of types of tape cartridge in terms of one property, and for which depths of recessed parts at another base-end-side part, which is a site that is further on a base end side than a base end portion of another hook, are different for a plurality of types of tape cartridge in terms of another property is mounted in the cartridge mounting portion, and one detection portion, an output of which changes depending on the depths of the recessed parts at the one base-end-side part in a state in which a tape cartridge is mounted in the cartridge mounting portion, and another detection portion, an output of which changes depending on the depths of the recessed parts at the other base-end-side part in a state in which a tape cartridge is mounted in the cartridge mounting portion are provided.

5. The tape printing apparatus according to claim 1, further comprising:

a cutter that cuts a tape reeled out from a tape cartridge mounted in the cartridge mounting portion; and a control unit that switches between allowing and prohibiting a cutting operation of the cutter in accordance with the output of the detection portion.

6. The tape printing apparatus according to claim 1, further comprising:

a thermal head that performs printing on a tape accommodated in a tape cartridge mounted in the cartridge mounting portion; and a control unit that controls the thermal head so as to switch a heat generation temperature in accordance with the output of the detection portion.

* * * * *